US011299942B1

(12) United States Patent
Chen et al.

(10) Patent No.: US 11,299,942 B1
(45) Date of Patent: Apr. 12, 2022

(54) DRILLING MACHINES AND METHODS THEREOF

(71) Applicant: SICHUAN HONGHUA PETROLEUM EQUIPMENT CO., LTD., Sichuan (CN)

(72) Inventors: Chong Chen, Guanghan (CN); Yu Tian, Guanghan (CN); Aimin Tang, Guanghan (CN); Hang Gao, Guanghan (CN); Zhigang Li, Guanghan (CN); Yan Lyu, Guanghan (CN); Bo He, Guanghan (CN); Xiaohu Li, Guanghan (CN)

(73) Assignee: SICHUAN HONGHUA PETROLEUM EQUIPMENT CO., LTD., Guanghan (CN)

( * ) Notice: Subject to any disclaimer, the term of this patent is extended or adjusted under 35 U.S.C. 154(b) by 0 days.

(21) Appl. No.: 17/305,869

(22) Filed: Jul. 16, 2021

(30) Foreign Application Priority Data

Sep. 27, 2020 (CN) ..... 202011034814.9

(51) Int. Cl.

| | |
|---|---|
| ***E21B 19/16*** | (2006.01) |
| ***E21B 19/07*** | (2006.01) |
| ***E21B 3/02*** | (2006.01) |
| ***E21B 19/15*** | (2006.01) |
| ***E21B 19/10*** | (2006.01) |

(52) U.S. Cl.
CPC ..... *E21B 19/165* (2013.01); *E21B 3/022* (2020.05); *E21B 19/07* (2013.01); *E21B 19/10* (2013.01); *E21B 19/155* (2013.01); *E21B 19/161* (2013.01)

(58) Field of Classification Search
CPC ..... E21B 19/165; E21B 19/07; E21B 19/10; E21B 19/155; E21B 19/161; E21B 3/022
See application file for complete search history.

(56) References Cited

U.S. PATENT DOCUMENTS 10,711,523 B2 7/2020 Taggart et al.
2010/0230115 A1* 9/2010 Belik ..... E21B 21/01 166/380

(Continued)

FOREIGN PATENT DOCUMENTS

CN 101612977 B 10/2012
CN 104563912 A 4/2015

(Continued)

*Primary Examiner* — Christopher J Sebesta
(74) *Attorney, Agent, or Firm* — Metis IP LLC

(57) ABSTRACT

The present disclosure discloses a drilling machine. The drilling machine may include a base, a mast arranged on the base, an iron roughneck, a drill floor mechanical arm, a top drive arranged on the mast, a pipe racker on a finger board, a power finger board, a power catwalk arranged on the ground, and an elevator arranged on the top drive. The drill machine and a corresponding tripping out and tripping in method may be used to vertically transport a stand between a well center and a region of at least one pipe setback efficiently, which may improve the efficiency of tripping out and tripping in, and reduce the risk of accidents in the well. In addition, the present disclosure provides a corresponding method for offline connecting and disconnecting stands during a drilling operation, which may reduce a preparation time during the drilling, improve the drilling efficiency, and reduce the cost of oilfield development.

16 Claims, 27 Drawing Sheets

(56) References Cited

U.S. PATENT DOCUMENTS

| | | | | |
|---|---|---|---|---|
| 2010/0326672 | A1* | 12/2010 | Childers | E21B 19/20 166/380 |
| 2018/0023346 | A1* | 1/2018 | Taggart | E21B 7/023 175/57 |
| 2020/0123861 | A1 | 4/2020 | Gupta et al. | |
| 2021/0002995 | A1* | 1/2021 | Botnan | E21B 19/165 |

FOREIGN PATENT DOCUMENTS

| | | | |
|---|---|---|---|
| CN | 205532274 | U | 8/2016 |
| CN | 106194067 | A | 12/2016 |
| CN | 104389536 | B | 1/2017 |
| CN | 107227934 | A | 10/2017 |
| CN | 109667554 | A | 10/2017 |
| CN | 206608120 | U | 11/2017 |
| CN | 105569566 | B | 8/2018 |
| CN | 110043203 | A | 7/2019 |
| CN | 111535758 | A | 8/2020 |

* cited by examiner

DRILLING MACHINES AND METHODS THEREOF

CROSS-REFERENCE TO RELATED APPLICATIONS

The present disclosure claims priority of Chinese application No. 202011034814.9 filed on Sep. 27, 2020, the contents of which are hereby incorporated by reference.

TECHNICAL FIELD

The present disclosure relates to devices and technology for drilling and mining petroleum and natural gas, and in particular, to efficient and offline drilling machines and methods for mining petroleum and natural gas.

BACKGROUND

With the development of drilling technology, the design and manufacturing of the drilling machine have been improved significantly. The speed of the research and development (R&D) has also been improved, and the direction of the R&D turns toward serialization, standardization, and diversification. Further, in recent years, the performance of the drilling machine has been improved greatly. At the same time, with the complexity of the on-site operation technology and operation processes, as well as more and more attention to safety and efficiency, there is a growing need for automation in the drilling operation. How to ensure the safety, reliability, and efficiency of the entire drilling system has become the key.

Nowadays, land drilling machines mainly use the following process for drilling and processing pipes. First, special vehicles transport a drilling machine to a well. An on-site crane is used to lift pipes to a pipe arrangement. Then, the worker operates a power catwalk to clamp a pipe from the pipe arrangement. The pipe is moved to a drill floor via the power catwalk. Accordingly, a driller operates a hydraulic elevator to clamp the pipe on the drill floor and lift the pipe via a top drive. When a connector at a lower portion of the pipe leaves the power catwalk, another driller lowers the pipe into a well center via an auxiliary tool or a drill floor righting mechanism. The another driller adjusts the pipe to vertical at the well center. Finally, a new pipe is connected with the pipe at the well center through an iron roughneck on the drill floor. The above operations are completed by the coordination of two or three workers. At the same time, during a process for connecting pipes, the well center is occupied, so that the drilling operation is inefficient and dangerous.

When tripping out at the well center, a string of the well center is lifted to a high position by the top drive. The string of the well center is placed on a slip. Accordingly, the iron roughneck is extended to the well center to break out the string. Then, a lower portion of a stand is arranged to a region of at least one pipe setback through a driller or a drill floor mechanical arm. Finally, an upper portion of the stand is transported to a mast worker or a pipe racker on a finger board through the top drive. The stand is arranged to the region of the at least one pipe setback through the mast worker or the pipe racker on the finger board. When the lower portion of the stand is arranged to the region of the at least one pipe setback from the well center, the stand always occupies a position of the well center, which may reduce the efficiency of tripping out and tripping in and increase the risk of accidents in the well. The tripping in process is the inverse of the tripping out process, which may have a similar problem.

According to commonly-accepted terms in the art, a drill rod refers to a single drill rod. A stand refers to a relatively long rod connected by a plurality of drill rods (e.g., 2 to 4 drill rods). A string refers to a pipe connected by a plurality of drill rods and placed in the well center. Alternatively, the string refers to a combination of a drill rod and a drill collar. In some embodiments, the string may include a plurality of sleeves. According to a number (count) of connected drill rods, a length of the string may be within a range from tens of meters to thousands of meters. The stand may be a plurality of connected drill rods separated from the string after breaking out.

SUMMARY

The purpose of the present disclosure is to overcome the above shortcomings in the art. The present disclosure provides a drill machine. The drill machine may be used to vertically transport a stand between a well center and a region of at least one pipe setback efficiently, which may improve the efficiency of tripping out and tripping in, and reduce the risk of accidents in the well. In addition, the present disclosure provides corresponding methods for offline connecting and disconnecting stands during a drilling operation, which may reduce a preparation time during the drilling, improve the drilling efficiency, and reduce the cost of oilfield development.

An aspect of the present disclosure relates to a drilling machine. The drilling machine may include a base, a mast arranged on the base, an iron roughneck, a power slip, a drill floor mechanical arm arranged on the base, a top drive and a power finger board arranged on the mast, a pipe racker on a finger board arranged on the power finger board, and an elevator arranged on the top drive. The elevator may be configured to tilt relative to a vertical direction. A region of at least one pipe setback may be disposed on a region in an upper surface of the base vertically corresponding to the power finger boards. The pipe racker on the finger board may include a clamp head and a transmission mechanism that moves the clamp head. The clamp head may be configured to clamp or support an upper portion of a stand. The drill floor mechanical arm may be configured to clamp or support a lower portion of the stand and coordinate with the clamp head to move the stand between a position of a well center and the region of the at least one pipe setback. One of the clamp head and the drill floor mechanical arm may clamp the stand, and the other of the clamp head and the drill floor mechanical arm may support the stand.

Another aspect of the present disclosure provides a tripping out method. The method may include the following steps.

In step 1, a top drive may be placed at a low position. An elevator may be opened to clamp a string of a well center. The elevator may be shut. The string of the well center may be lifted upward.

In step 2, a power slip may be turned off. The string may be placed on the power slip after the top drive arrives at a high position.

In step 3, an iron roughneck may be extended to the well center to break out. An upper portion of the string may be fixed via the elevator of the top drive.

In step 4, the iron roughneck may be retracted. A pipe racker on a finger board and a drill floor mechanical arm may be extended to the well center, synchronously. A clamp head of the pipe racker on the finger board may be opened to clamp or support an upper portion of a stand. A clamp head of the drill floor mechanical arm may be opened to clamp or support a lower portion of the stand.

In step 5, the elevator of the top drive may be opened. The elevator may be tilted backward.

In step 6, the pipe racker on the finger board and the drill floor mechanical arm may be retracted, rotated, and moved, synchronously, to transport the stand to a region of at least one pipe setback. The stand may remain vertical during the transportation of the stand.

In step 7, the stand may be lowered to the region of the at least one pipe setback by the pipe racker on the finger board or the drill floor mechanical arm. The clamp head of the pipe racker on the finger board and the clamp head of the drill floor mechanical arm may be opened and retracted, synchronously.

In step 8, the pipe racker on the finger board and the drill floor mechanical arm may be moved, rotated, or extended to a position close to the well center, synchronously, to wait for clamping a next stand.

In some embodiments, when a next stand needs to be tripped out after the step 4 is finished, the top drive may be moved downward to the low position to perform the step 1 and continue to a next cycle after the stand is out of the well center during the steps 6-8.

A further aspect of the present disclosure provides a tripping in method. The method may include the following steps.

In step 1, a stand may be clamped, by one of a pipe racker on a finger board and a drill floor mechanical arm, and supported, by the other of the pipe racker on the finger board and the drill floor mechanical arm, to transport the stand to a position of a well center. During the transportation of the stand, the stand may remain vertical and a thread grease doper may be used to dope a thread grease.

In step 2, the stand may be placed, by the pipe racker on the finger board and the drill floor mechanical arm, on a top end of a lower string. The stand may be lifted by an elevator. The stand may be loosened by the pipe racker on the finger board and the drill floor mechanical arm. The pipe racker on the finger board and the drill floor mechanical arm may be moved to a region of at least one pipe setback to prepare to clamp a next stand.

In step 3, an iron roughneck may be extended to the well center to make up. The iron roughneck may be reset after the making up.

In step 4, the stand may be lowered, by the elevator, to the lower position. The power slip may be turned off. The elevator may be opened to tilt backward. The top drive may be moved upward.

When the tripping in of the drilling machine is continued, the steps 1-4 may be repeated from the step 1. The step 4 may be performed synchronously with the steps 1-2.

In some embodiments, using the thread grease doper to dope the thread grease in step 1 may be doping the thread grease on a lower portion of the stand during the transportation of the stand.

A still further aspect of the present disclosure provides a method for connecting stands offline. The method may include the following steps.

In step 1, a first pipe may be obliquely transported to a drill floor via a power catwalk. A front portion of the first pipe may be clamped using a clamp head of a stand-connecting mechanical arm. The first pipe may be carried to move upward and adjusted to vertical by the stand-connecting mechanical arm. The clamp head of the stand-connecting mechanical arm may be moved to a position right above a mouse hole A. The first pipe may be carried downward and placed into the mouse hole A by the stand-connecting mechanical arm.

In step 2, a second pipe may be obliquely transported to the drill floor via the power catwalk. A front portion of the second pipe may be clamped using the clamp head of the stand-connecting mechanical arm. The second pipe may be carried to move upward and adjusted to vertical by the stand-connecting mechanical arm. The clamp head of the stand-connecting mechanical arm may be moved to a position right above a mouse hole B. The second pipe may be carried downward and placed into the mouse hole B by the stand-connecting mechanical arm.

In step 3, a third pipe may be obliquely transported to the drill floor via the power catwalk. A front portion of the third pipe may be clamped using the clamp head of the stand-connecting mechanical arm. The third pipe may be carried to move upward and adjusted to vertical by the stand-connecting mechanical arm. The clamp head of the stand-connecting mechanical arm may be moved to the position right above the mouse hole A or the mouse hole B. The third pipe may be carried downward. A connector at a lower portion of the third pipe may be placed into a connector at an upper portion of the first pipe or the second pipe.

In step 4, an iron roughneck may be extended to the mouse hole including two pipes to make up the two pipes to form a double stand. The iron roughneck may be retracted after making up the two pipes.

In step 5, the double stand may be clamped, by the stand-connecting mechanical arm, to move upward until a lower end of the double stand is higher than the drill floor. The stand-connecting mechanical arm may be synchronously moved to a position right above the other pipe in the other mouse hole. The double stand may be lowered downward until a connector at the lower portion of the double stand is placed into a connector at an upper portion of the other pipe. A clamp head of a drill floor mechanical arm may support the lower portion of the double stand before the connector at the lower portion of the double stand leaves the drill floor.

In step 6, the iron roughneck may be extended to the mouse hole including three pipes to make up the double stand and the other pipe to form a triple stand. The iron roughneck may be retracted after making up the double stand and the other pipe.

In step 7, the triple stand may be clamped, by the stand-connecting mechanical arm, to move upward until a connector at a lower portion of the triple stand leaves the drill floor. The clamp head of the drill floor mechanical arm may support the lower portion of the triple stand before the connector at the lower portion of the triple stand leaves the drill floor.

In step 8, an upper portion of the triple stand may be clamped or supported by a pipe racker on a finger board. The clamp head of the stand-connecting mechanical arm may be opened and driven to move upward. A lower portion of the triple stand may be clamped or supported by the drill floor mechanical arm.

In step 9, the triple stand may be vertically transported, by the pipe racker on the finger board and the drill floor mechanical arm, to a region of at least one pipe setback, synchronously.

In step 10, the triple stand may be lowered, by the pipe racker on the finger board or the drill floor mechanical arm, to the region of the at least one pipe setback. The clamp head of the pipe racker on the finger board and the clamp head of the drill floor mechanical arm may be opened and retracted, synchronously. The drill floor mechanical arm may be returned to a storage region.

A still further aspect of the present disclosure provides a method connecting stands offline. The method may include the following steps.

In step 1, a first pipe may be obliquely transported to a drill floor via a power catwalk. A front portion of the first pipe may be clamped using a clamp head of a stand-connecting mechanical arm. The first pipe may be carried to move upward and adjusted to vertical by the stand-connecting mechanical arm. The clamp head of the stand-connecting mechanical arm may be moved to a position right above a mouse hole A. The first pipe may be carried downward and placed into the mouse hole A by the stand-connecting mechanical arm.

In step 2, a second pipe may be obliquely transported to the drill floor via the power catwalk. A front portion of the second pipe may be clamped using the clamp head of the stand-connecting mechanical arm. The second pipe may be carried to move upward and adjusted to vertical by the stand-connecting mechanical arm. The clamp head of the stand-connecting mechanical arm may be moved to the position right above the mouse hole A. The second pipe may be carried downward. A connector at a lower portion of the second pipe may be placed into a connector at an upper portion of the first pipe.

In step 3, an iron roughneck may be extended to the mouse hole A to make up the first pipe and the second pipe to form a double stand. The iron roughneck may be retracted after making up the first pipe and the second pipe.

In step 4, the double stand may be clamped, by the stand-connecting mechanical arm, to move upward until a connector at a lower portion of the double stand leaves the drill floor. A clamp head of a drill floor mechanical arm may support the lower portion of the double stand before the connector at the lower portion of the double stand leaves the drill floor.

In step 5, an upper portion of the double stand may be clamped or supported by a pipe racker on a finger board. The clamp head of the stand-connecting mechanical arm may be opened and driven to move upward. A lower portion of the double stand may be clamped or supported by the drill floor mechanical arm.

In step 6, the double stand may be vertically transported, by a pipe racker on a finger board and the drill floor mechanical arm, to a region of at least one pipe setback, synchronously.

In step 7, the double stand may be lowered, by the pipe racker on the finger board or the drill floor mechanical arm, to the region of the at least one pipe setback. The clamp head of the pipe racker on the finger board and the clamp head of the drill floor mechanical arm may be opened and retracted, synchronously. The drill floor mechanical arm may be returned to a storage region.

The present disclosure may include the following beneficial effects.

Firstly, during the tripping out and tripping in, the pipe racker on the finger board and the drill floor mechanical arm may be used to vertically transport pipes, synchronously, which may reduce a well center occupy time when the stand is transported. The drilling machine with an original structure may be used to vertically transport the stand, thereby improving the efficiency of tripping out and tripping in, and reducing the risk of accidents in the well. Secondly, the top drive in the present disclosure may include no horizontal telescopic mechanism. Differences between sizes of the mast and the base in the present disclosure and those in the existing drilling machine may not be large.

Therefore, the top drive in the present disclosure may be suitable for modified and new drilling machines. Thirdly, during the drilling, connecting stands offline using the stand-connecting mechanical arm, the pipe racker on the finger board, the drill floor mechanical arm, the iron roughneck, the power catwalk, and two mouse holes in the present disclosure may reduce a preparation time during the drilling, improve the drilling efficiency, and reduce the cost of oilfield development.

DETAILED DESCRIPTION

Figure 1:
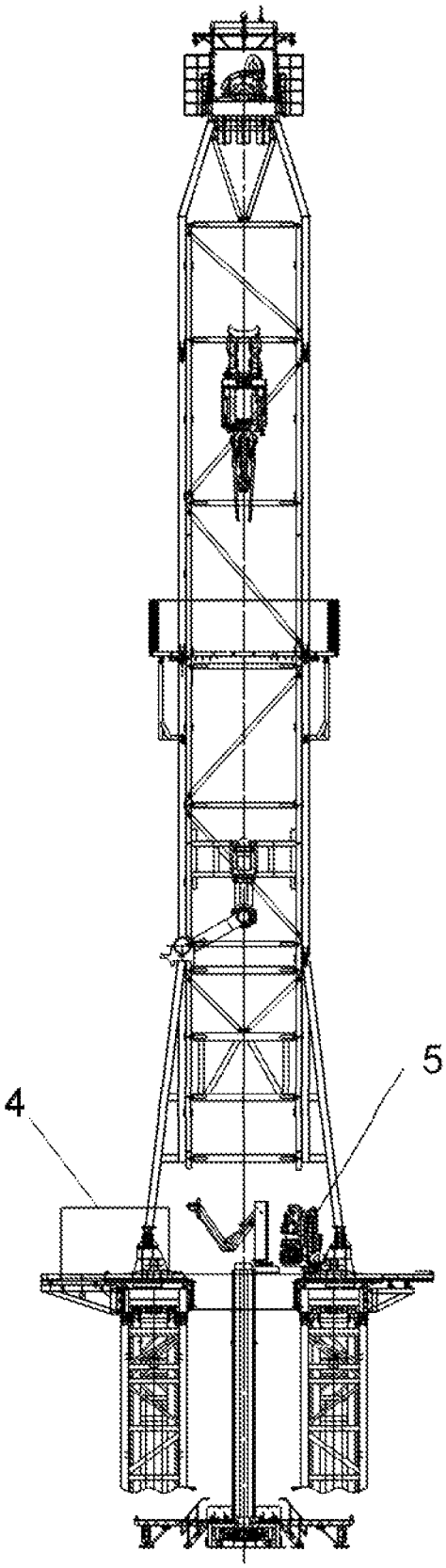
FIG. 1 is a schematic diagram illustrating an exemplary drilling machine according to some embodiments of the present disclosure.
Figure 2:
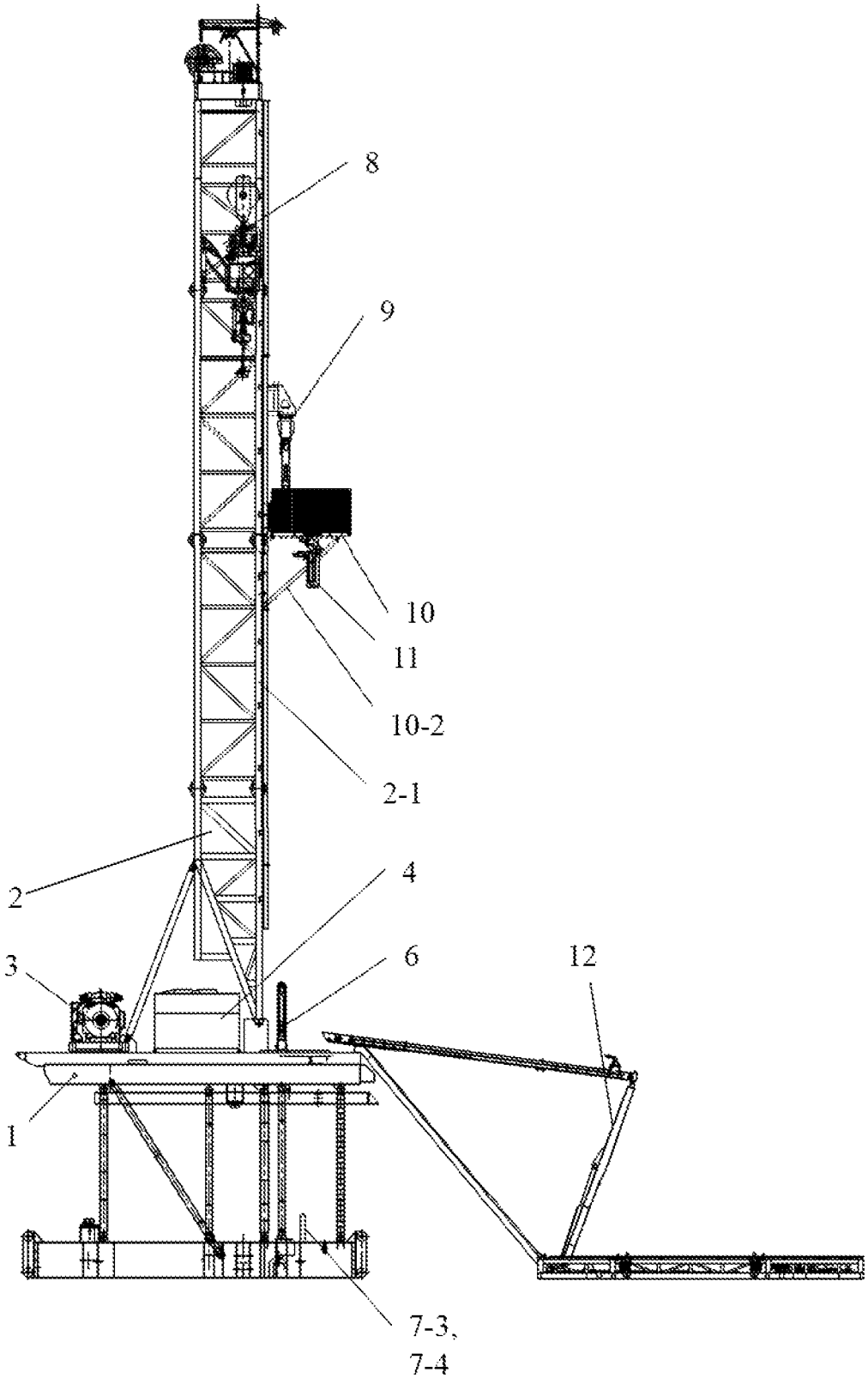
FIG. 2 is a schematic diagram illustrating a side view of the drilling machine in FIG. 1.
Figure 3:
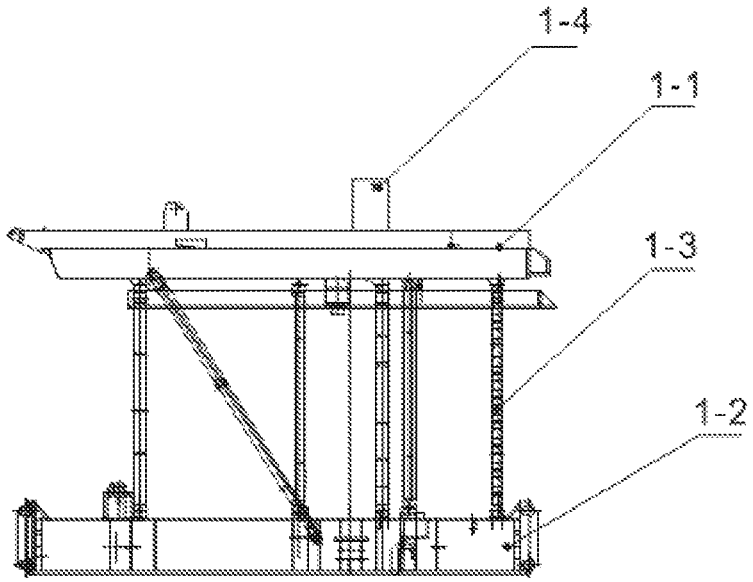
FIG. 3 is a schematic diagram illustrating a base of the drilling machine in FIG. 1.

In order to make the present disclosure more clearly, the technical solutions in the present disclosure may be described clearly and completely with reference to the accompanying drawings in some embodiments of the present disclosure. It should be understood that the drawings are merely for the purposes of illustration and description, and are not intended to limit the protection scope of the present disclosure. The techniques that are implemented in the present disclosure are within the scope of the present disclosure.

In some embodiments, as shown in FIGS. 1-7 and 16, the drilling machine may include a base (1), a mast (2) arranged on the base (1), a drawwork (3), a driller room (4), an iron roughneck (5), a drill floor mechanical arm (6), a mouse hole A (7-1) and a mouse hole B (7-2), a top drive (8) arranged on the mast (2), a stand-connecting mechanical arm (9), a power finger board (10), a pipe racker (11) on a finger board, and a power catwalk (12) arranged on the ground.

In some embodiments, the base (1) may include an upper seat (1-1), a lower seat (1-2), an intermediate outrigger (1-3) disposed between the upper seat (1-1) and the lower seat (1-2), a support seat (1-4) disposed on the upper seat (1-1), and a connection support. In some embodiments, the upper seat (1-1) and the lower seat (1-2) may be connected by the intermediate outrigger (1-3). The lower seat (1-2) may be connected via the connection support.

In some embodiments, the mast (2) may be arranged on the base (1). For example, a lower portion of the mast (2) may be hinged with the support seat (1-4) on the base (1). A load on the mast (2) may act on the base (1) via the support seat (1-4). In some embodiments, a base of the drawwork (3) may be arranged in an upper surface of the upper seat (1-1) via a pin or bolt. In some embodiments, the top drive (8) may be pulled to move in a vertical direction via a traction rope by the drawwork (3). In some embodiments, a position of the drawwork (3) may be disposed in a moving direction of the top drive (8) to reduce the traction of the drawwork (3) to pull the top drive (8). In some embodiments, the driller room (4) may be arranged in the upper surface of the upper seat (1-1), and fixed to the upper surface of the upper seat (1-1) via a bolt or pin. A position of the driller room (4) may be located at a side of the mast (2). In some embodiments, the iron roughneck (5) may be arranged in the upper surface of the upper seat (1-1). A position of the iron roughneck (5) may be located at a side of the mast (2) and located at an opposite side of the driller room (4). In some embodiments, the iron roughneck (5) may be extended horizontally. An operation range of the iron roughneck (5) may include a well center and a position for connecting stands offline.

Figure 4:
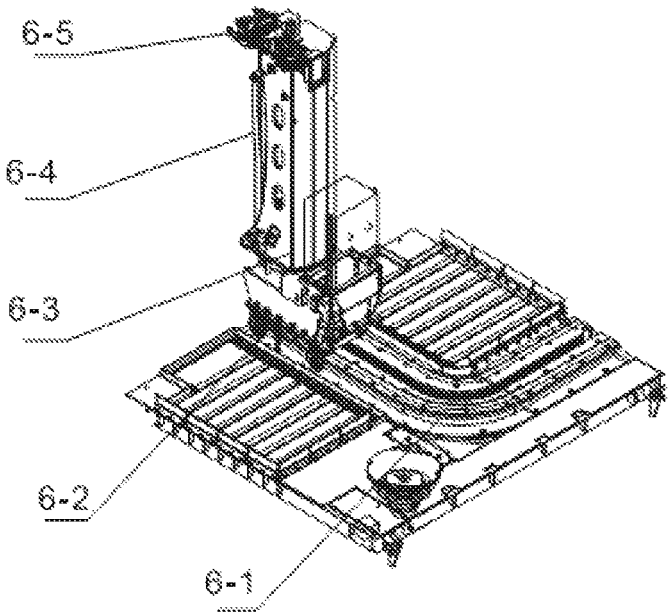
FIG. 4 is a schematic diagram illustrating a drill floor mechanical arm of the drilling machine in FIG. 1.
Figure 5:
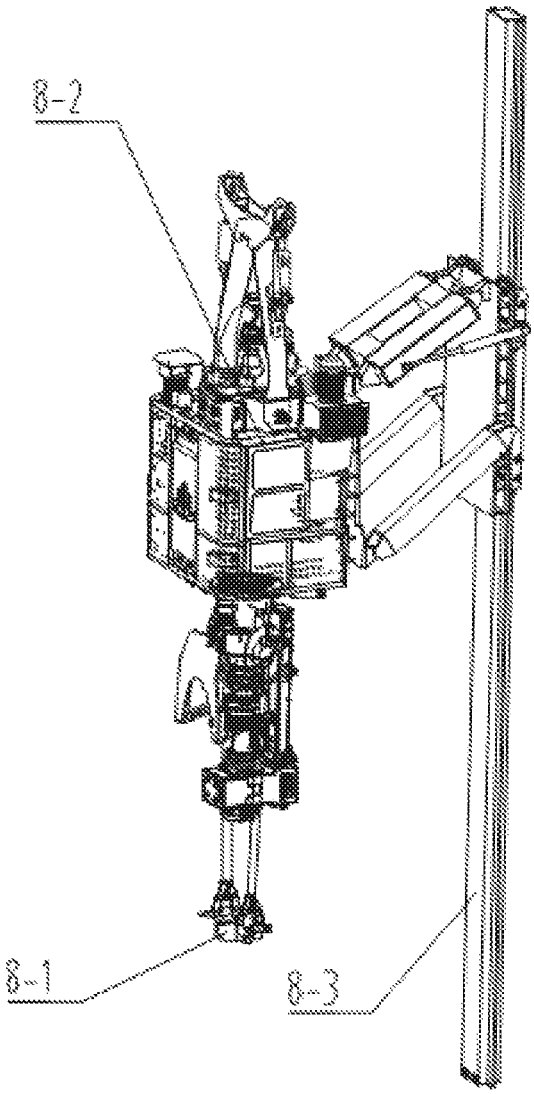
FIG. 5 is a schematic diagram illustrating a top driver of the drilling machine in FIG. 1.
Figure 16:
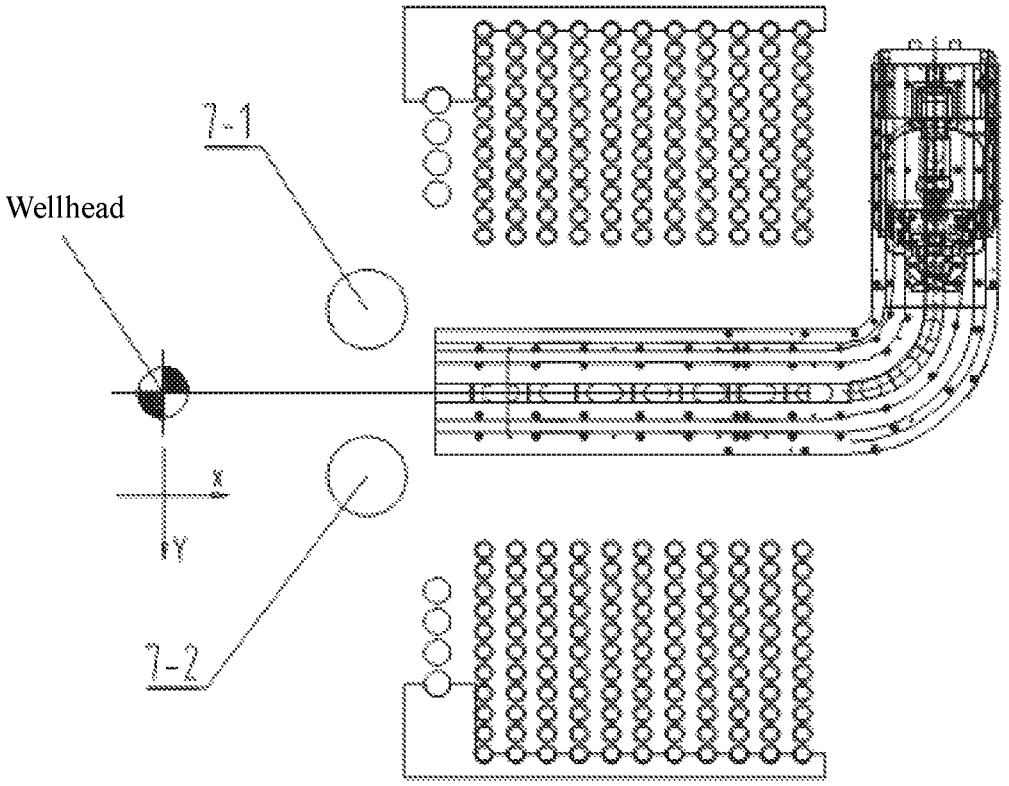
FIG. 16 is a schematic diagram illustrating a top view of a mouse hole A, a mouse hole B, and a drill floor mechanical arm according to some embodiments of the present disclosure.
Figure 17:
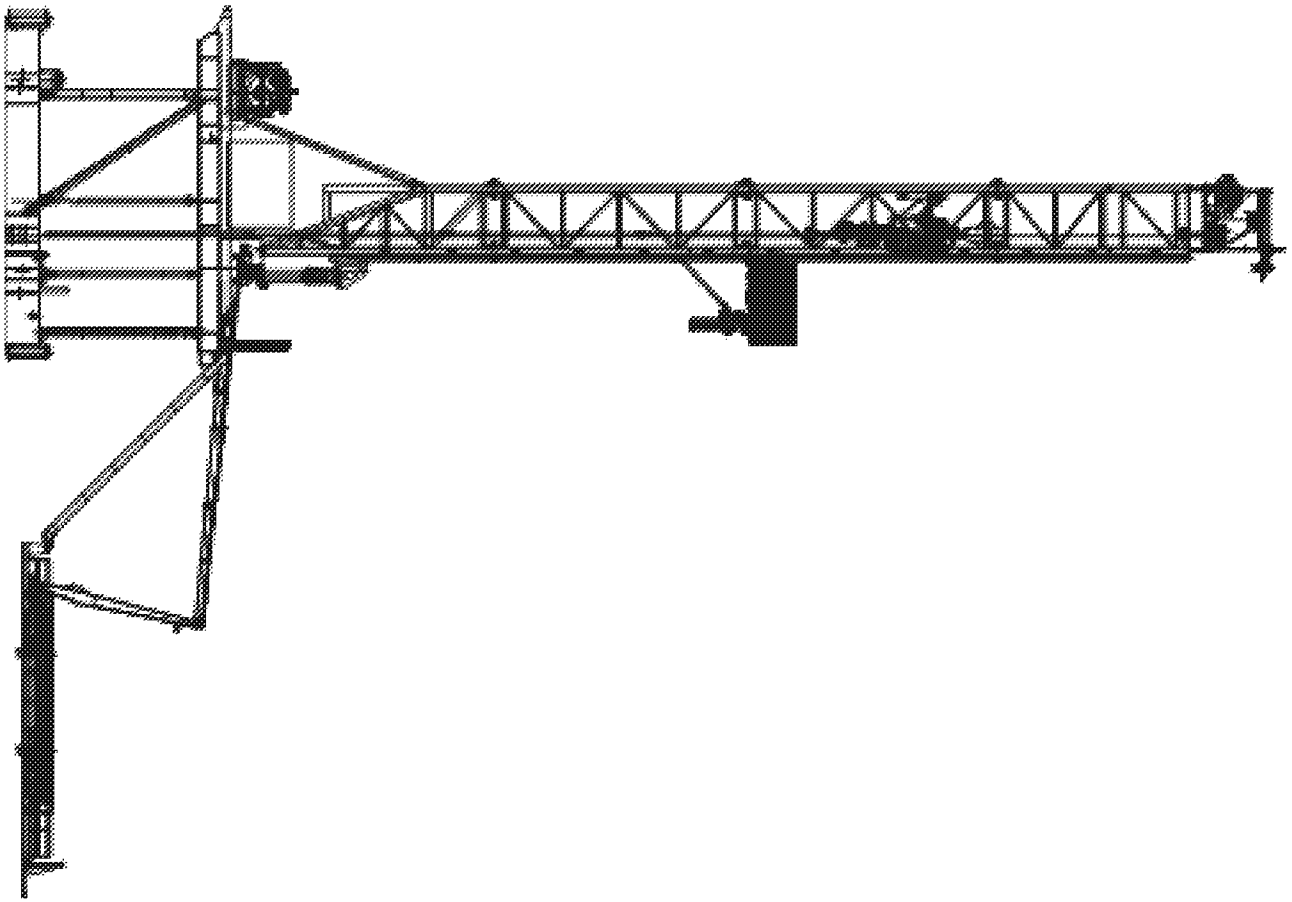
FIGS. 17-28 are schematic diagrams illustrating an exemplary process for connecting stands according to some embodiments of the present disclosure.
Figure 18:
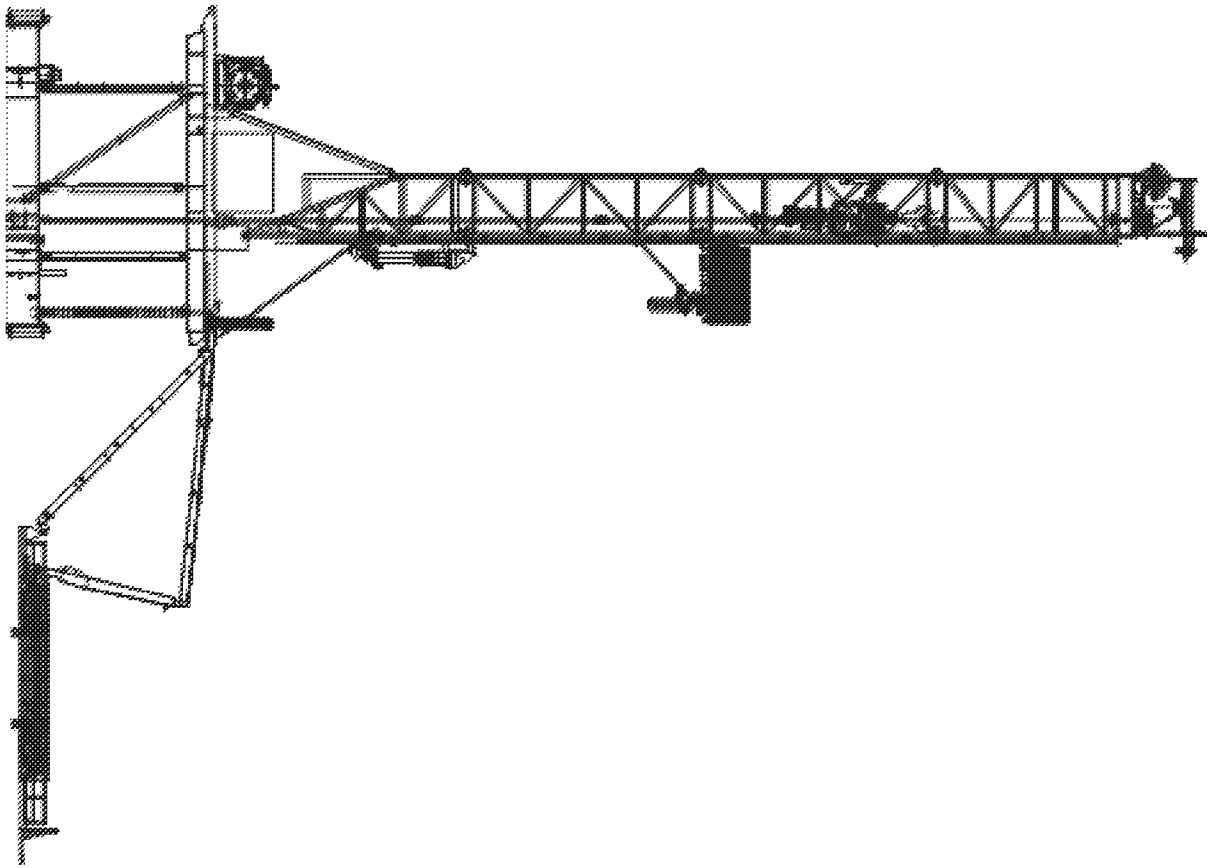
Figure 19:
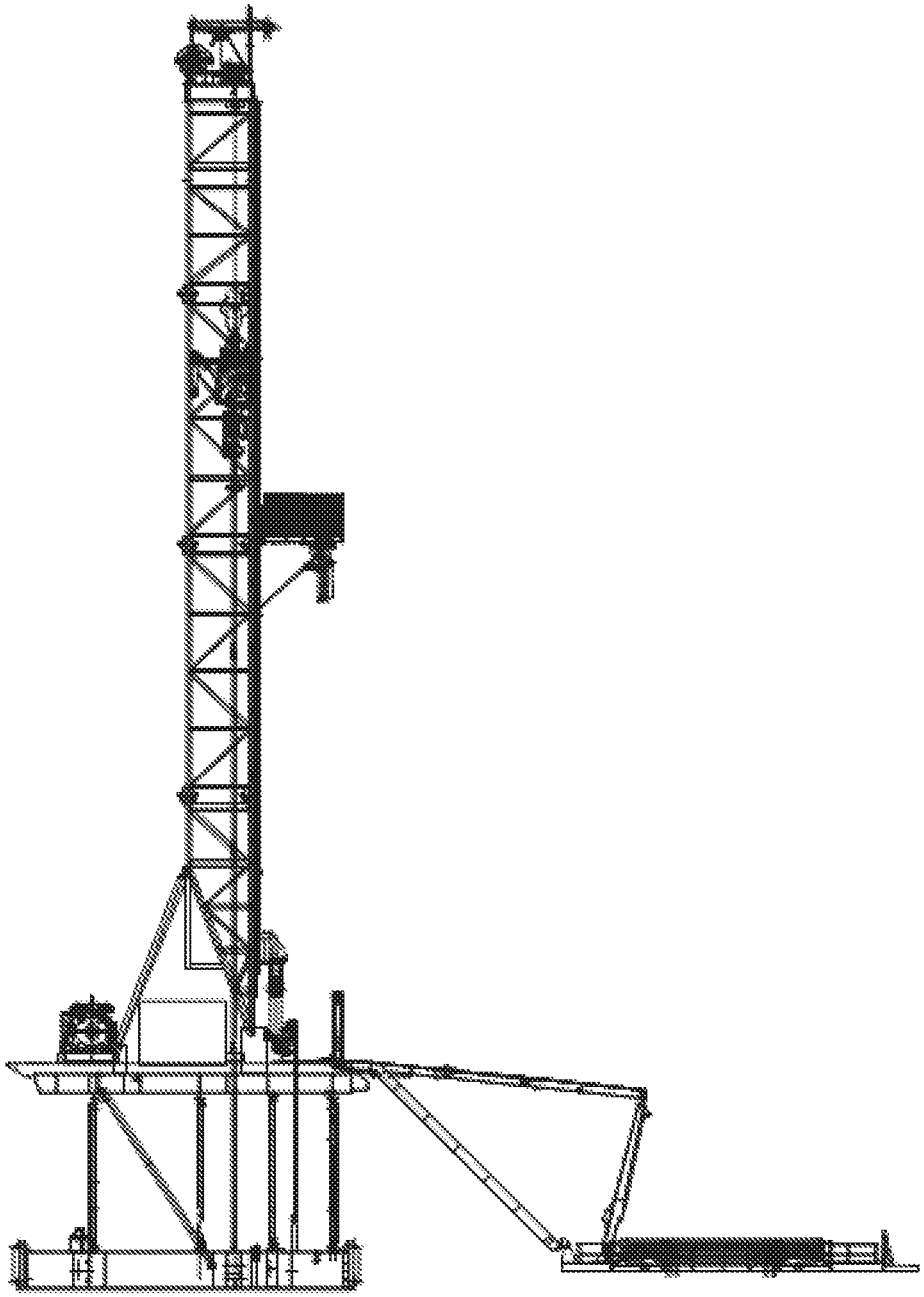
Figure 20:
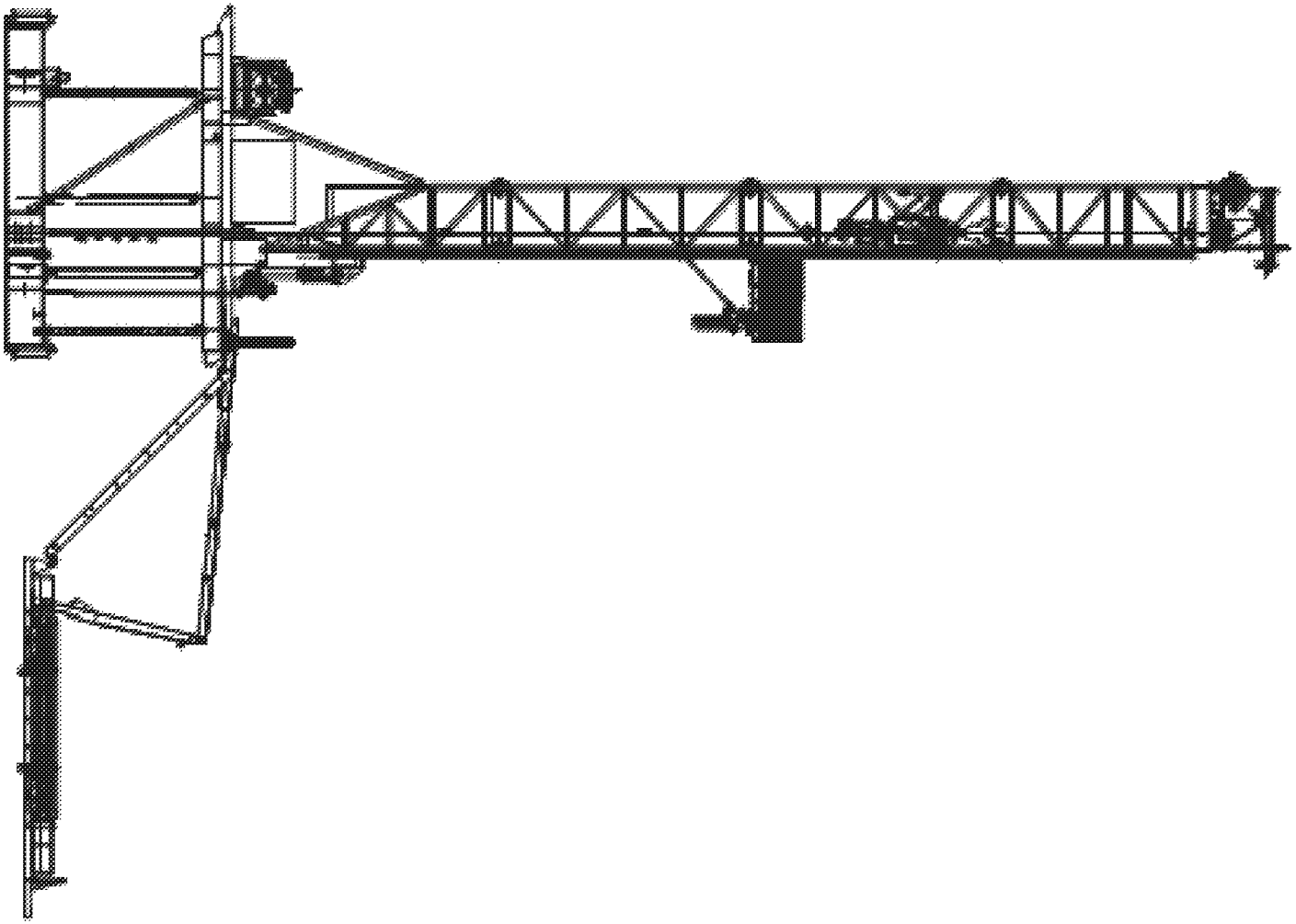
Figure 21:
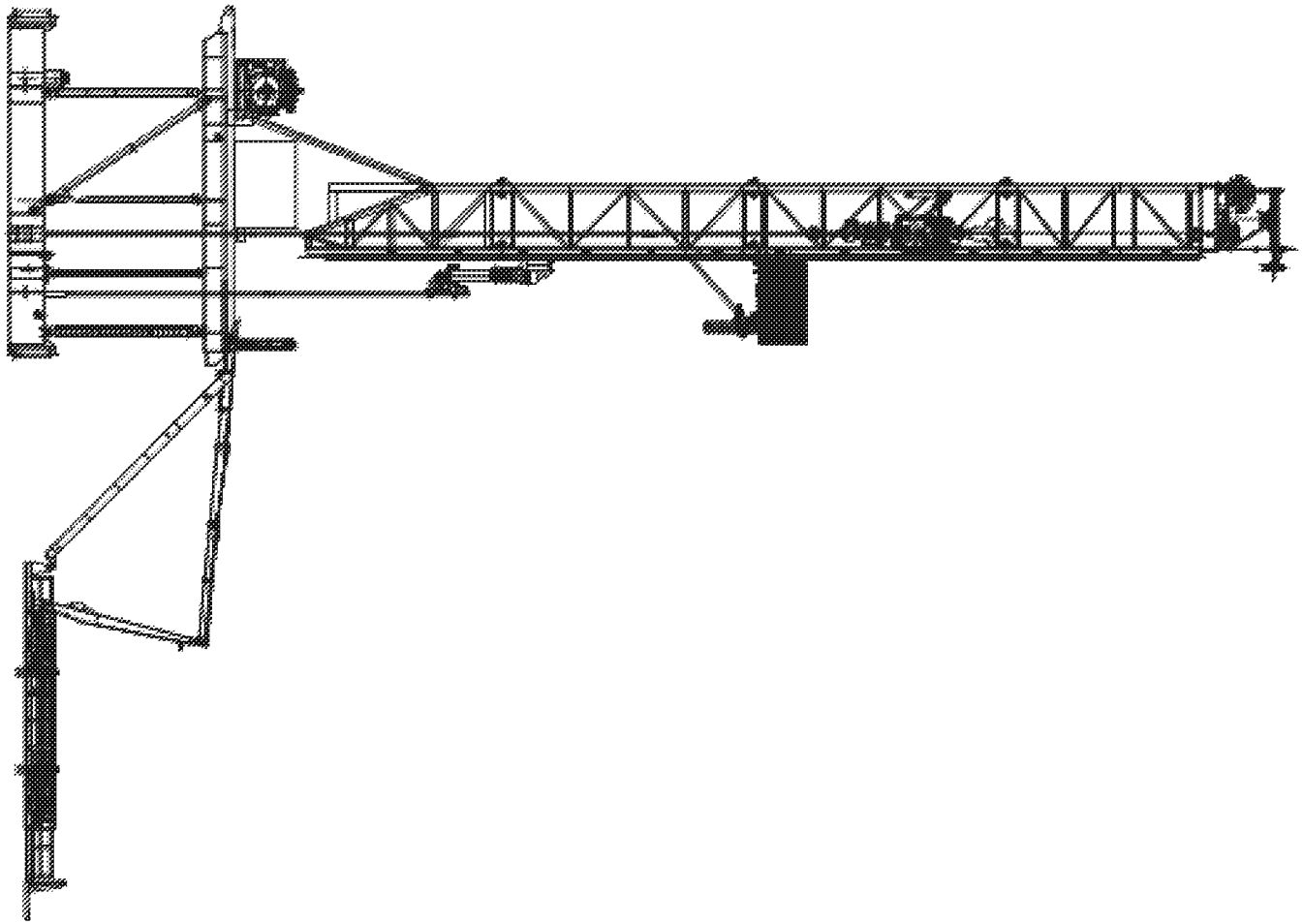
Figure 22:
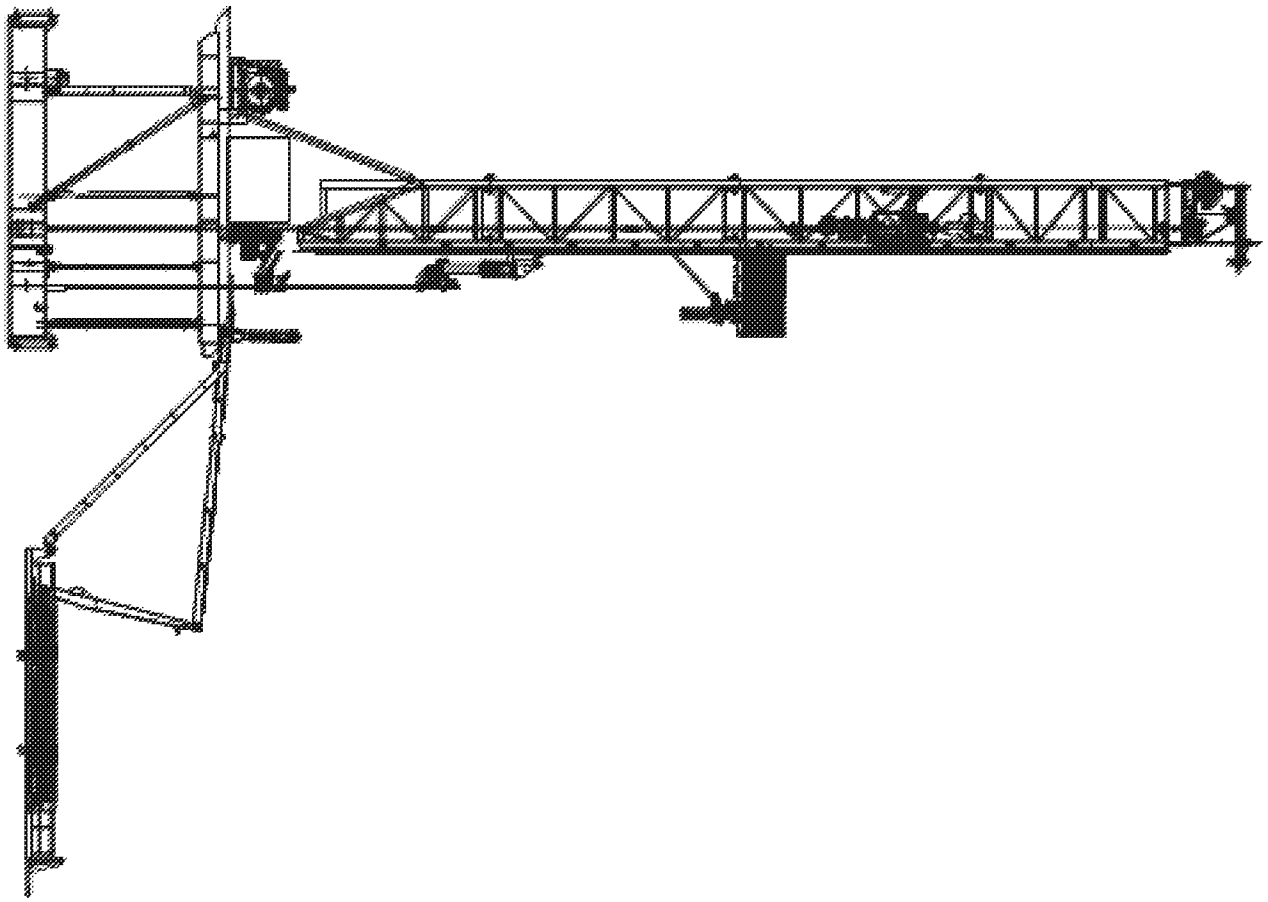
Figure 23:
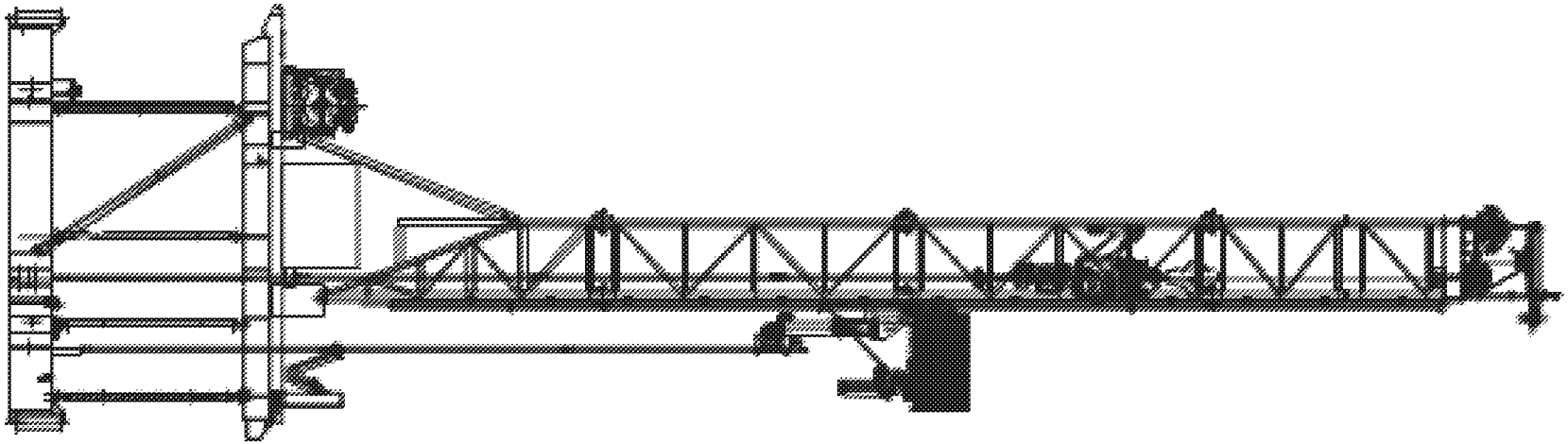
Figure 24:
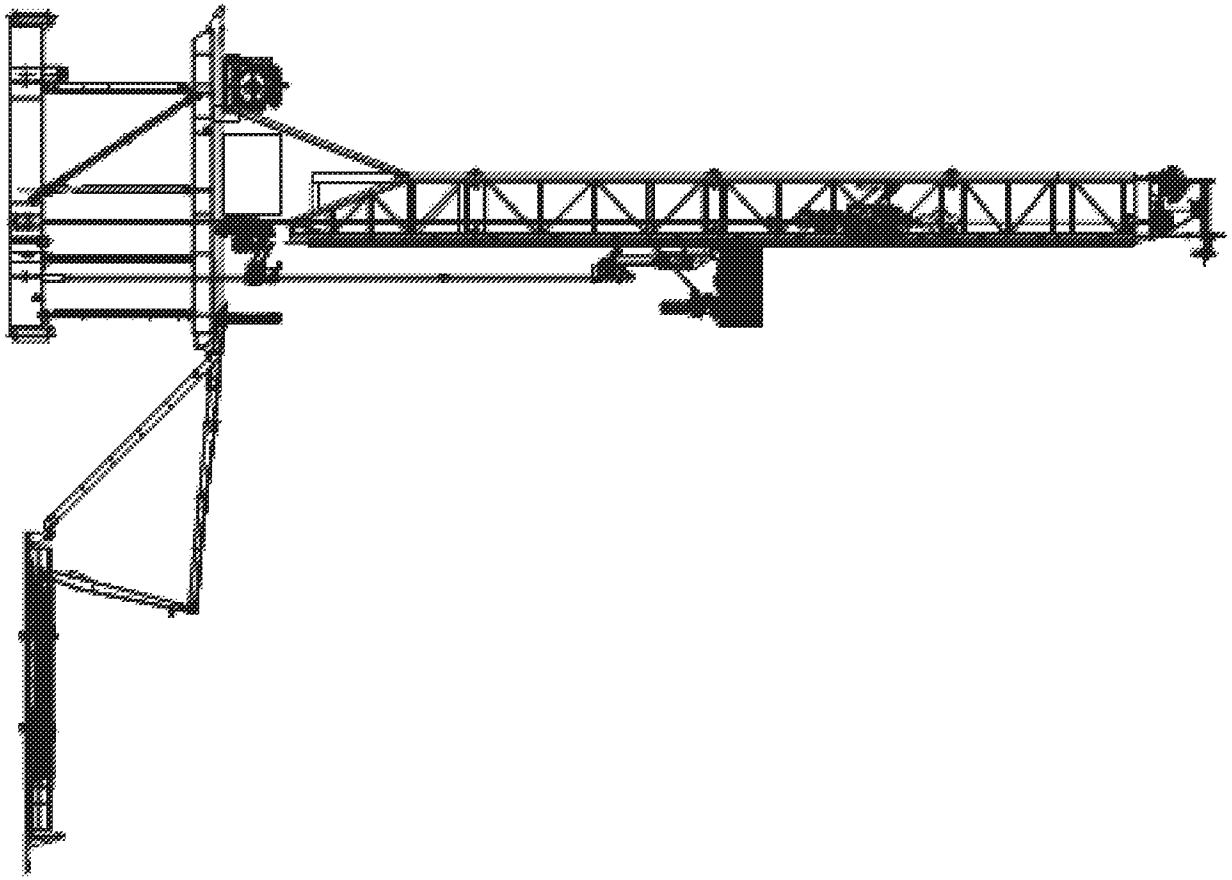
Figure 25:
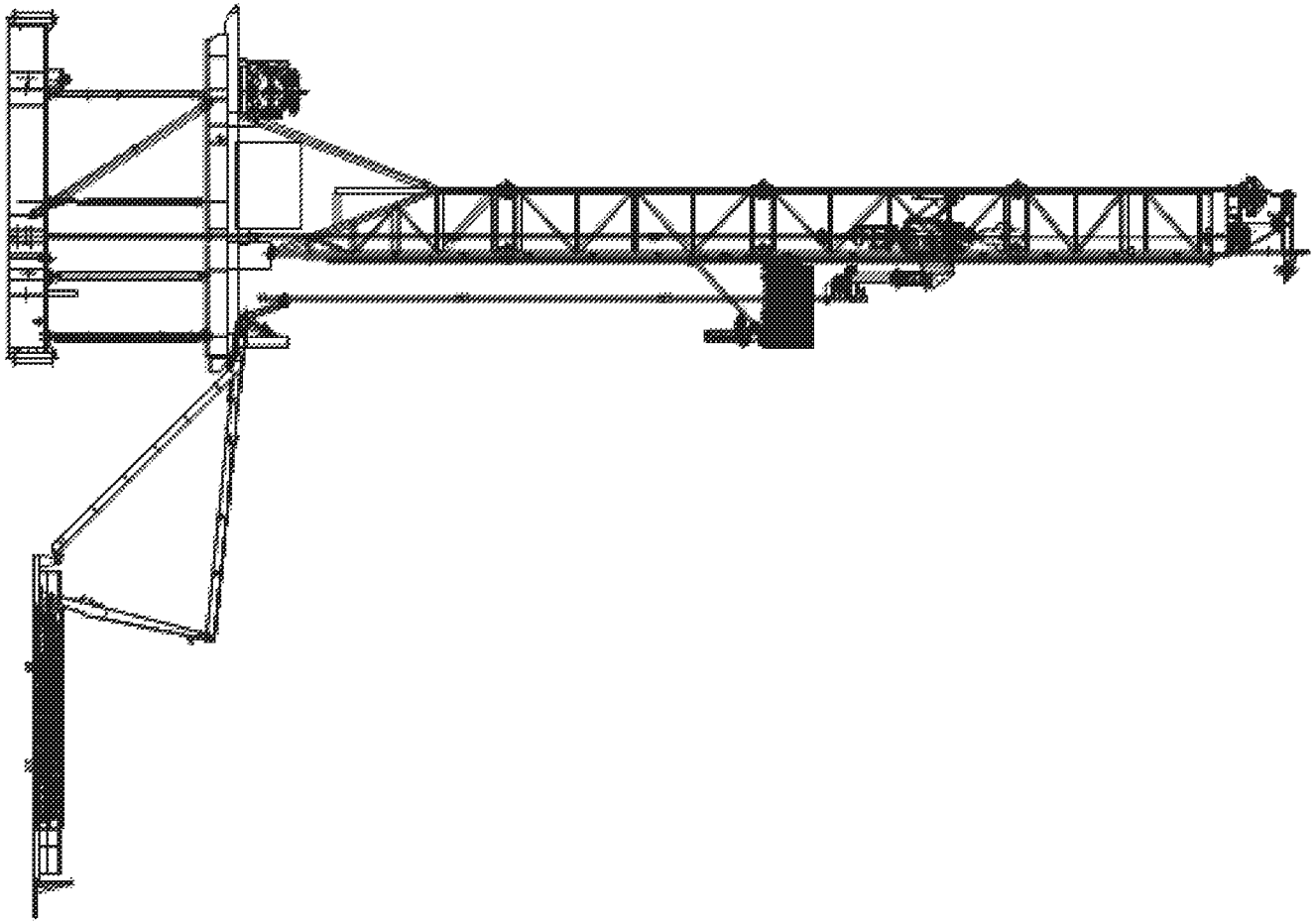
Figure 26:
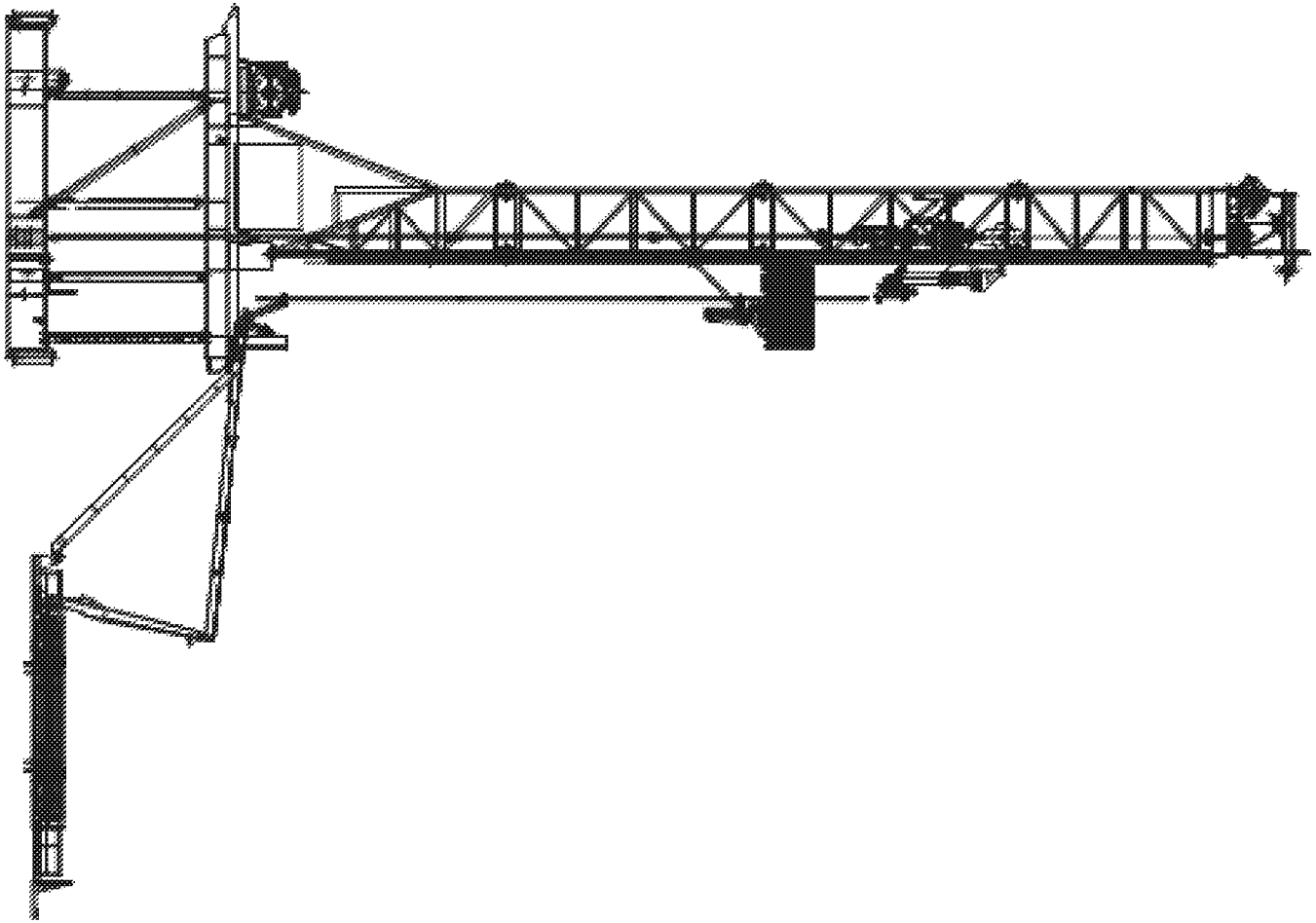
Figure 27:
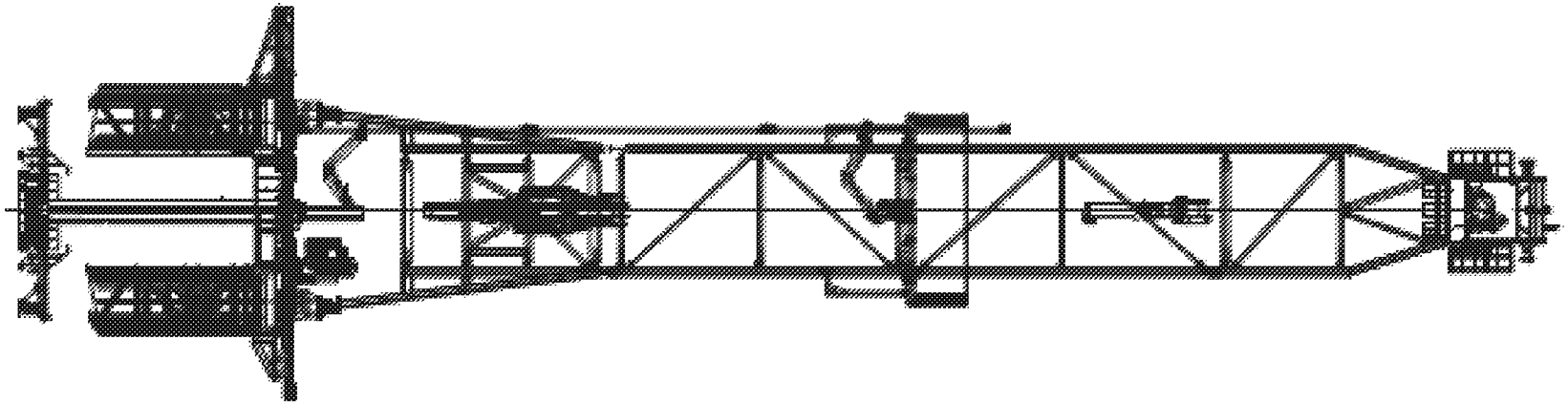
Figure 28:
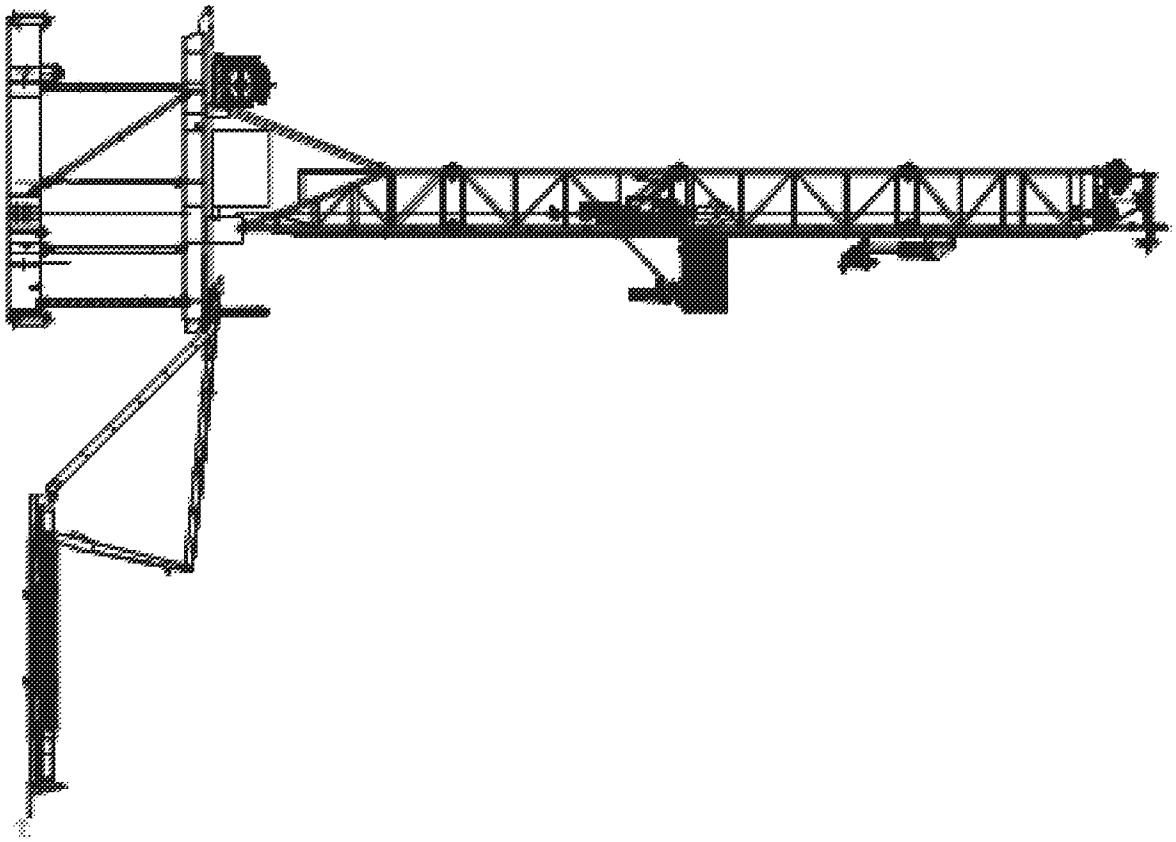
Figure 29:
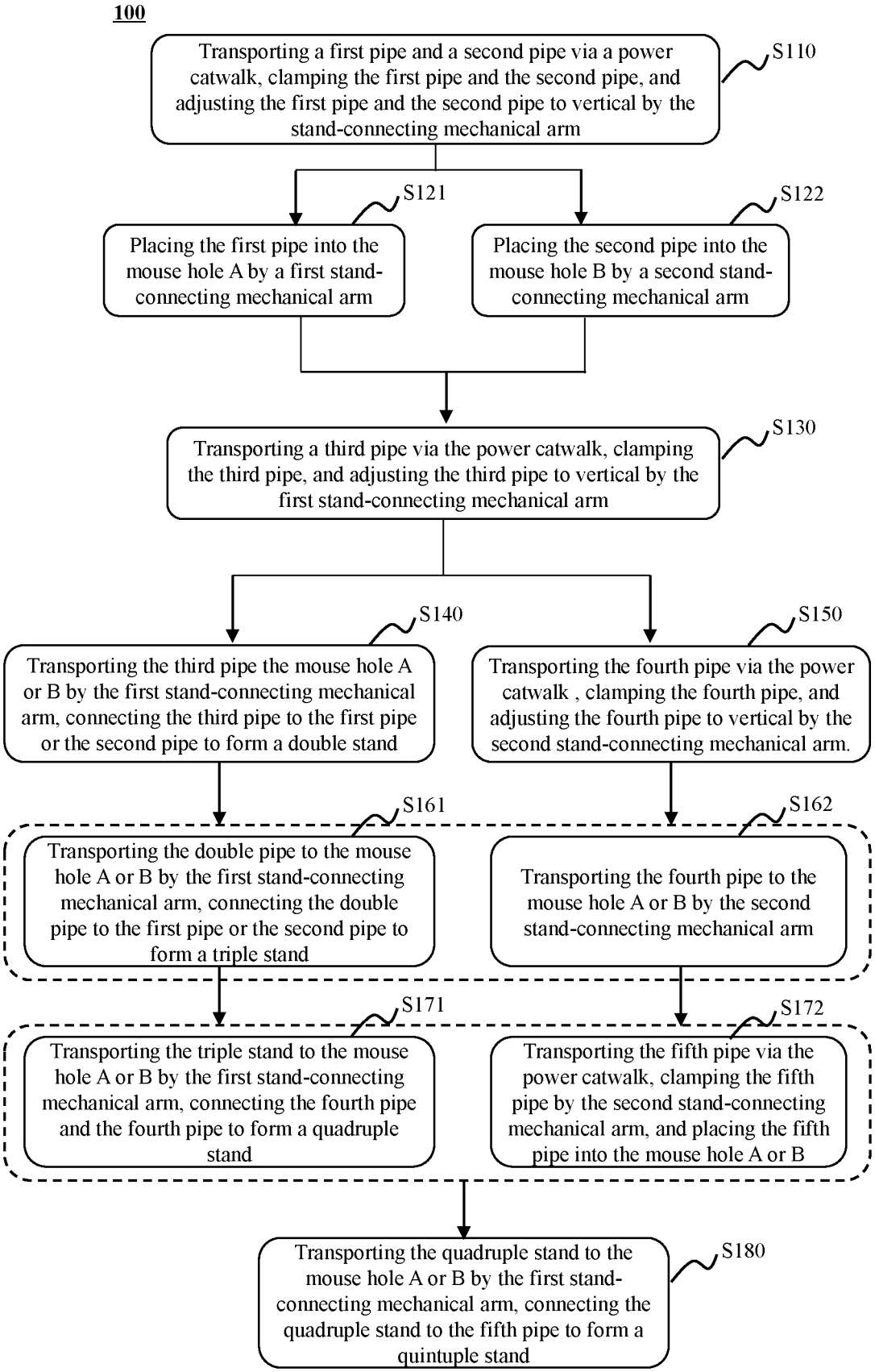
FIG. 29 is a flowchart illustrating an exemplary process for connecting stands according to some embodiments of the present disclosure.

In some embodiments, the drill floor mechanical arm (6) may be used to transport a drill rod or a stand. In some embodiments, as shown in FIG. 4 and FIG. 16, the drill floor mechanical arm (6) may include a rail (6-1), a travelling mechanism (6-2), a string (6-3), a telescopic mechanism (6-4), and a guide clamp (6-5). In some embodiments, the drill floor mechanical arm (6) may be arranged between the well center and the power catwalk (12), opposite the drawwork (3) relative to the well center. The rail (6-1) may be disposed on the base (1) and located between at least one pipe setback to form an L-shape. The travelling mechanism (6-2) may be arranged on the rail (6-1). The travelling mechanism (6-2) may be moved between a position close to the well center and a position close to the power catwalk (12) along the rail (6-1). The string (6-3) may be arranged on the travelling mechanism (6-2). The telescopic mechanism (6-4) may be arranged on the string (6-3). The telescopic mechanism (6-4) may be moved up and down along the string (6-3). The telescopic mechanism (6-4) may be extended or retracted relative to the string (6-3). The guide clamp (6-5) may be arranged on an end portion of the telescopic mechanism (6-4) for clamping or supporting a pipe. In some embodiments, the pipe may include, but not be limited to, a drill rod, a stand, a drill collar, a sleeve, etc. When the power catwalk (12) transports a pipe to a drill floor, the drill floor mechanical arm (6) may be located at a front end of the storage pipe setback and allows an area of a drill pipe. When the drill floor mechanical arm (6) has a lifting function, a lifting mechanism may be added to the string (6-3). In some embodiments, the lifting mechanism may include, but not be limited to, a cylinder, a gear rack, or the like.

The mouse hole may be used to place a pipe (e.g., the drill rod, the stand, etc.) so that the drill rods may be connected to form the stand. In some embodiments, as shown in FIG. 16, the mouse hole A (7-1) and the mouse hole B (7-2) may be disposed on the base (1). The mouse hole A (7-1) and the mouse hole B (7-2) may be positioned between the at least one pipe setback and the well center. In some embodiments, the mouse hole A (7-1) and the mouse hole B (7-2) may be symmetrical to a center line of the rail (6-1). In some embodiments, the pipe setback may also include two pipe setbacks symmetrical to the center line of the rail (6-1). In some embodiments, the mouse hole A (7-1) and the mouse hole B (7-2) may be disposed adjacent to each side of the two pipe setbacks, so that the connected stand may be transported to place into the nearby pipe setback from the mouse hole A (7-1) and the mouse hole B (7-2). In some embodiments, the lower seat (1-2) of the base (1) may be disposed with lower supports (7-3, 4) of the mouse hole A (7-1) and the mouse hole B (7-2) for supporting the drill rods in the mouse hole A (7-1) and the mouse hole B (7-2). During a process for connecting stands offline, if there is a filling in a circle of the mouse hole A (7-1) or the mouse hole B (7-2), the mouse hole A (7-1) or the mouse hole B (7-2) may be placed a pipe. If there is no filling in the circle of the mouse hole A (7-1) or the mouse hole B (7-2), the mouse hole A (7-1) or the mouse hole B (7-2) may not be placed a pipe.

In some embodiments, a number (count) of mouse holes may be one or multiple. In some embodiments, the number (count) of mouse holes may be set according to a maximum length of the stand. In some embodiments, the number (count) of mouse holes may be determined according to Equation (1):

$$Nm=Nc-1. \tag{1}$$

As used herein, Nm refers to the number (count) of mouse holes. Nc refers to a number (count) of drill rods used to be connected.

For example, when the maximum length of the connecting stand is 4 stands (i.e., four drill rods are connected to form a stand), the number (count) of mouse holes may be 3. As another example, when the maximum length of the connecting stand is 3 stands (i.e., three drill rods are connected to form a stand), the number (count) of mouse holes may be 2. More descriptions regarding connecting stands using the plurality of mouse holes may be found elsewhere in the present disclosure, which is not repeated.

In some embodiments, the number (count) of mouse holes may be fixed to two. In some embodiments, the drilling machine may perform an operation for connecting stands with any length using two mouse holes. More descriptions regarding connecting stands with any length using two mouse holes may be found elsewhere in the present disclosure, which is not repeated.

The top drive (8) may include a power elevator (8-1) (also referred to as elevator (8-1)), a top drive body (8-2), and a top drive rail (8-3). The top-drive rail (8-3) may be vertically arranged on a rear surface of the mast (2). The top drive (8) may be moved up and down along the top drive rail (8-3). A lower end of the top drive (8) may be arranged with the power elevator (8-1). The power elevator (8-1) may be opened and closed by a hydraulic source. In some embodiments, the power elevator (8-1) may be tilted relative to a vertical direction to make room for an upper end of the pipe. For example, the power elevator (8-1) may be tilted to a position close to the top drive rail (8-3). The position where the power elevator (8-1) is located before tilted may be used to accommodate an upper end of a pipe.

Figure 6:
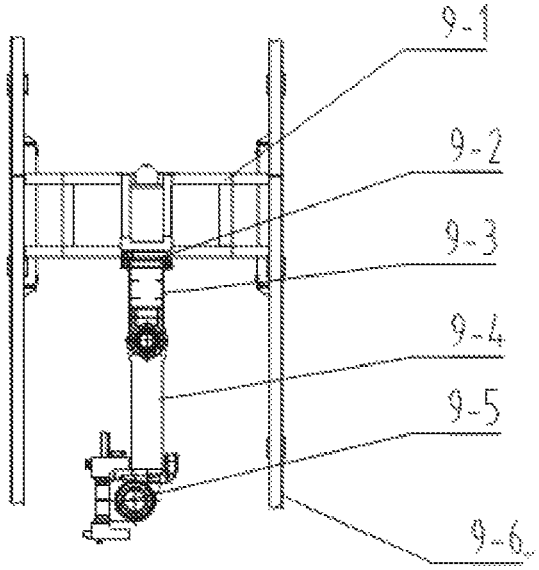
FIG. 6 is a schematic diagram illustrating a stand-connecting mechanical arm of the drilling machine in FIG. 1.

In some embodiments, the stand-connecting mechanical arm (9) may be arranged on the mast and configured to move up-and-down along the mast, clamping and driving a pipe to move. In some embodiments, the stand-connecting mechanical arm (9) may be used to transport the drill rod or the stand to the mouse hole for connecting stands. In some embodiments, the stand-connecting mechanical arm (9) may also be used to transport the connected stand to a region of at least one pipe setback. As shown in FIG. 6, the stand-connecting mechanical arm (9) may include a slip mechanism (9-1), a rotary reducer (9-2), a rotary support seat (9-3), a variable amplitude mechanism (9-4), a clamp head (9-5), and a slip rail (9-6). The slip rail (9-6) may be arranged on a front (or side) surface of a main leg (2-1) of the mast (2). The slip mechanism (9-1) may be moved vertically along the slip guide (9-6). The rotary reducer (9-2) may be arranged on the slip mechanism (9-1). The rotary support seat (9-3) may be connected to the rotary reducer (9-2). The variable amplitude mechanism (9-4) may be arranged on the rotary support seat (9-3). The clamp head (9-5) may be arranged on the variable amplitude mechanism (9-4). The connection and coordination of the above components may enable the clamp head (9-5) to move to a designated position. In some embodiments, a number (count) of the stand-connecting mechanical arm (9) may be two. For example, the drilling machine may include a first stand-connecting mechanical arm and a second stand-connecting mechanical arm. In some embodiments, the two stand-connecting mechanical arms may be used to transport different drill rods or stands to the mouse hole or the at least one pipe setback, respectively.

A platform of the power finger board (10) may be arranged on a front surface of the main leg (2-1) of the mast (2). The platform and the main leg (2-1) of the mast (2) may be connected via a pin or bolt. A lower surface of the platform and the main leg (2-1) of the mast (2) may be hinged by an inclined strut (10-2).

Figure 7:
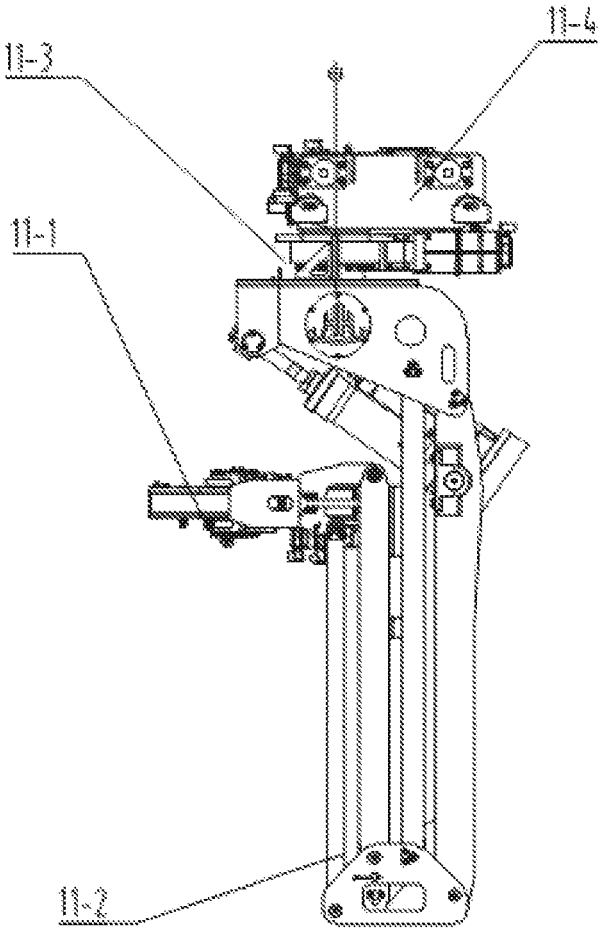
FIG. 7 is a schematic diagram illustrating a pipe racker on a finger board of the drilling machine in FIG. 1.
Figure 8:
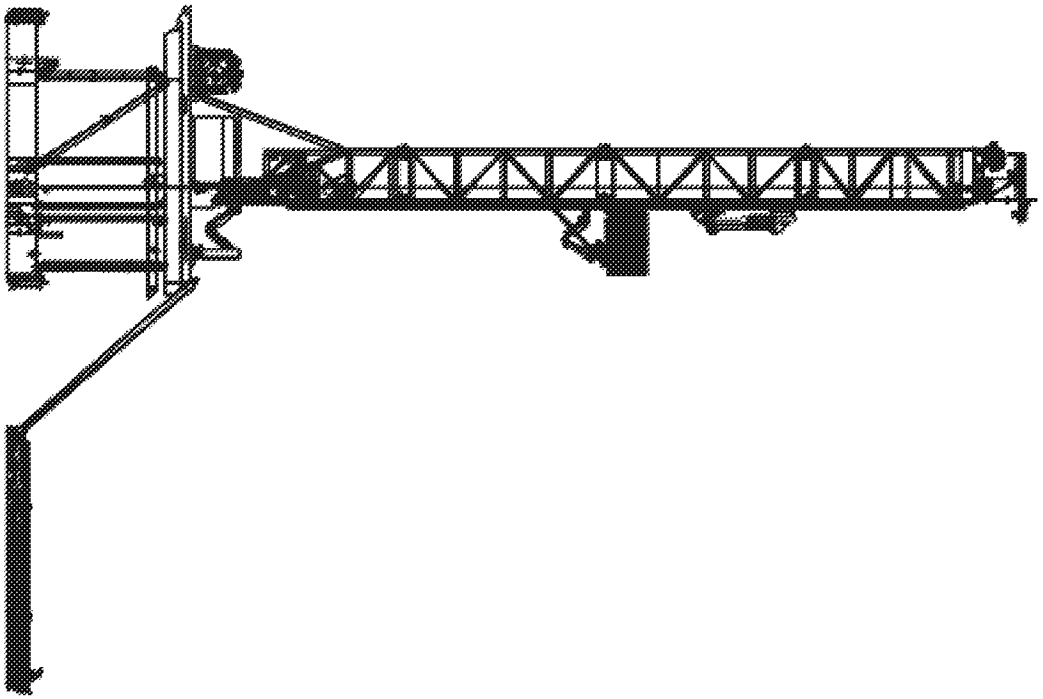
FIGS. 8-15 are schematic diagrams illustrating an exemplary process of tripping out according to some embodiments of the present disclosure.
Figure 9:
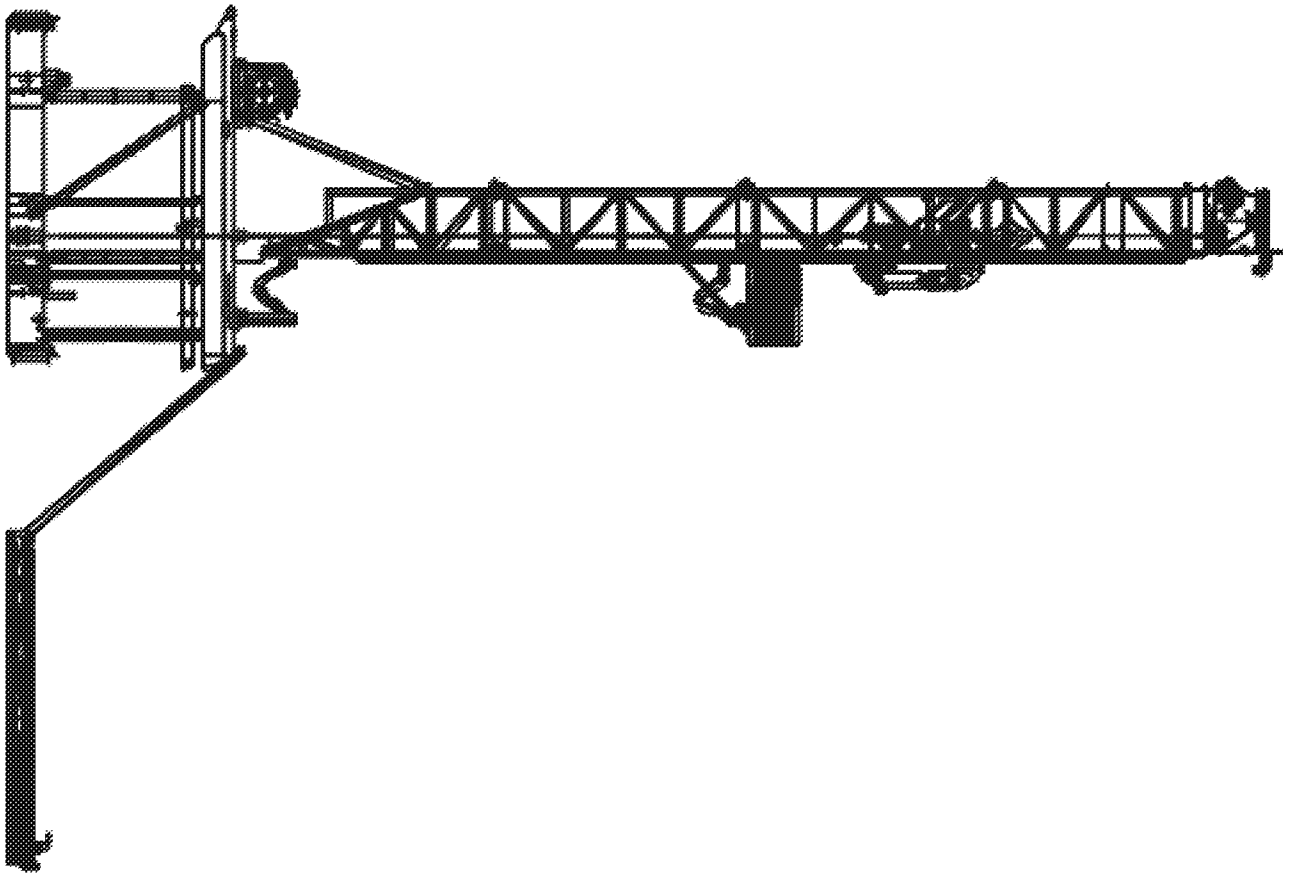
Figure 10:
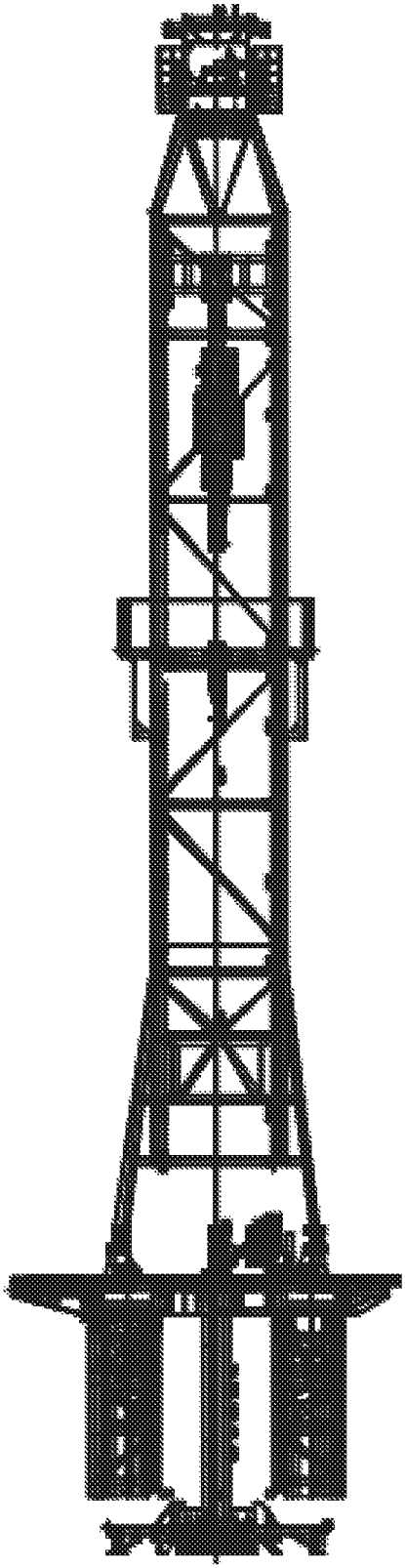
Figure 11:
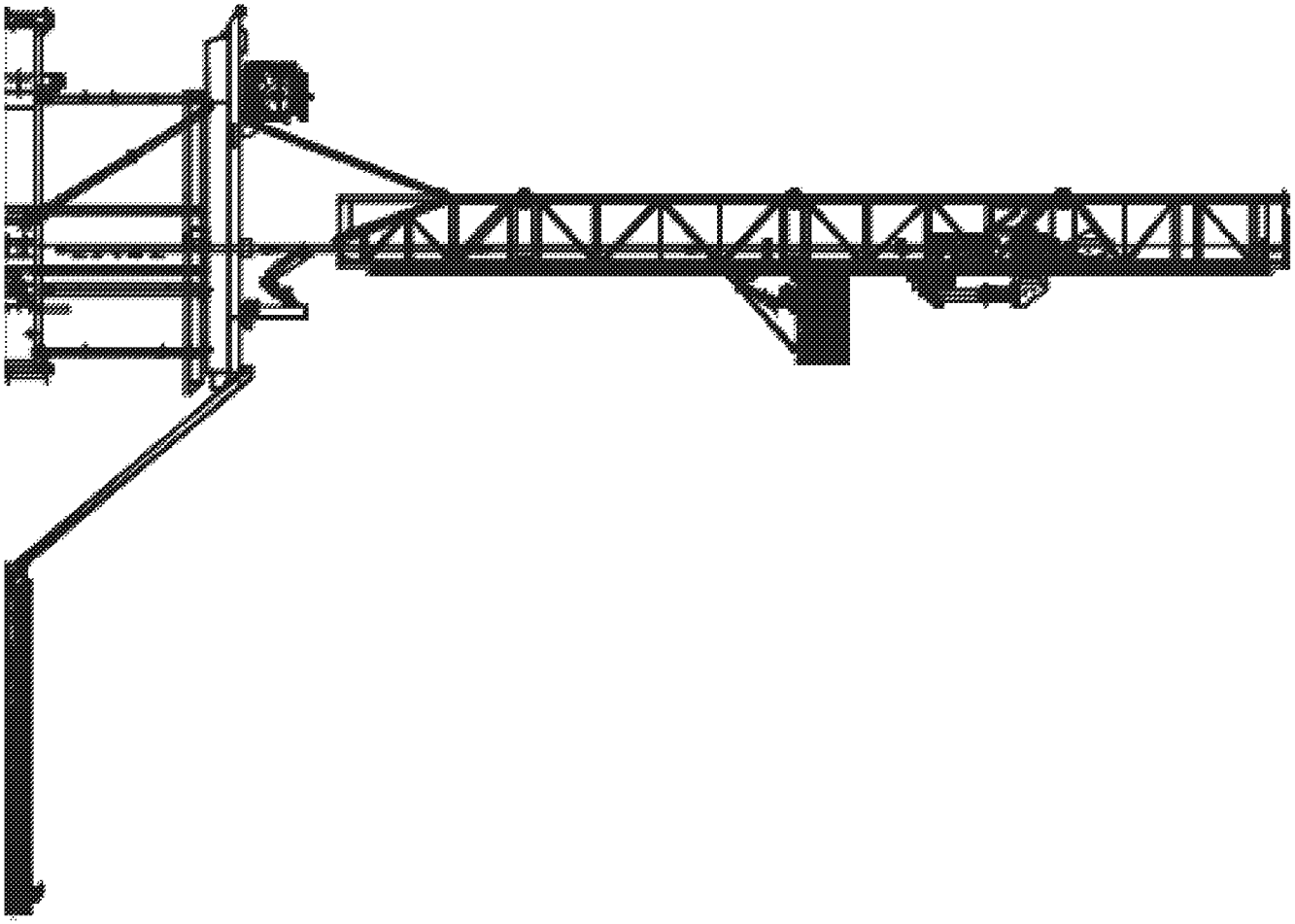
Figure 12:
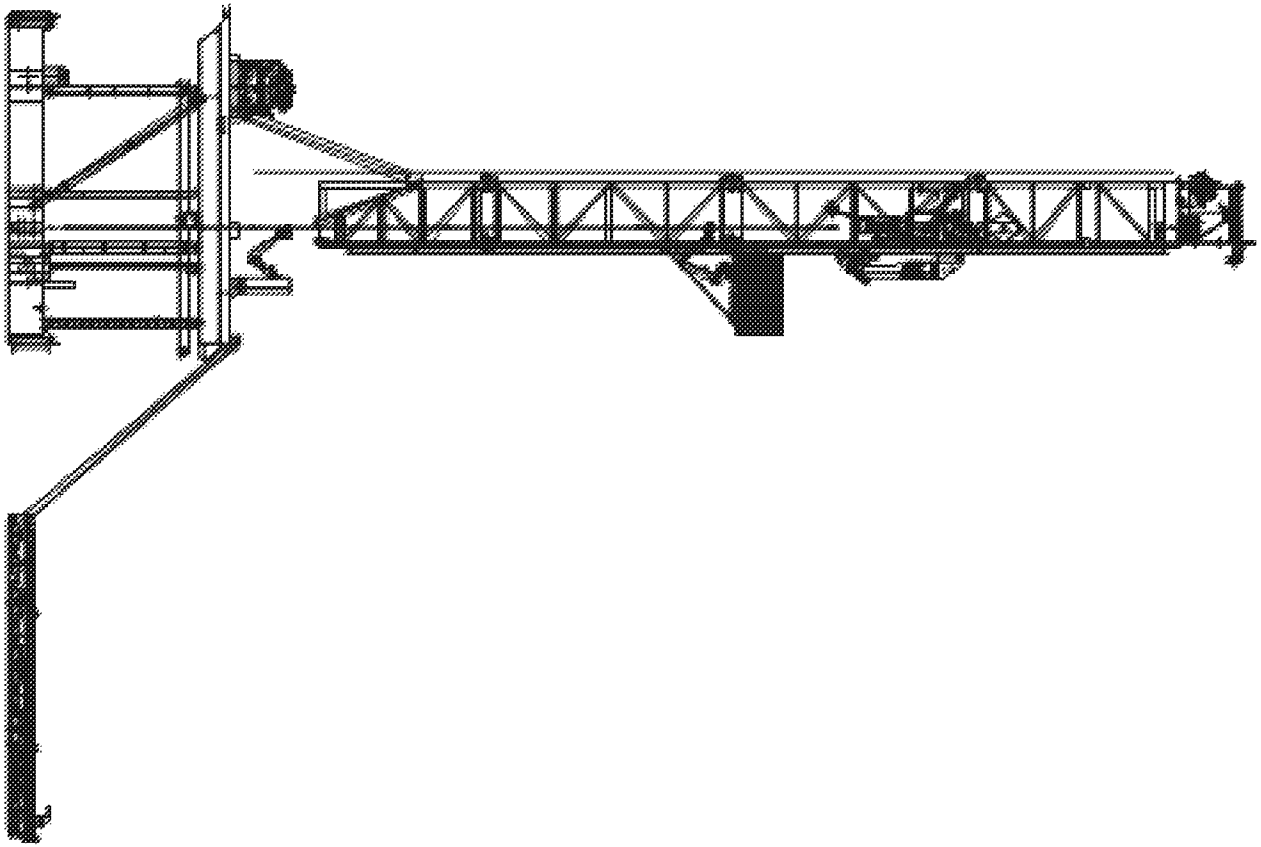
Figure 13:
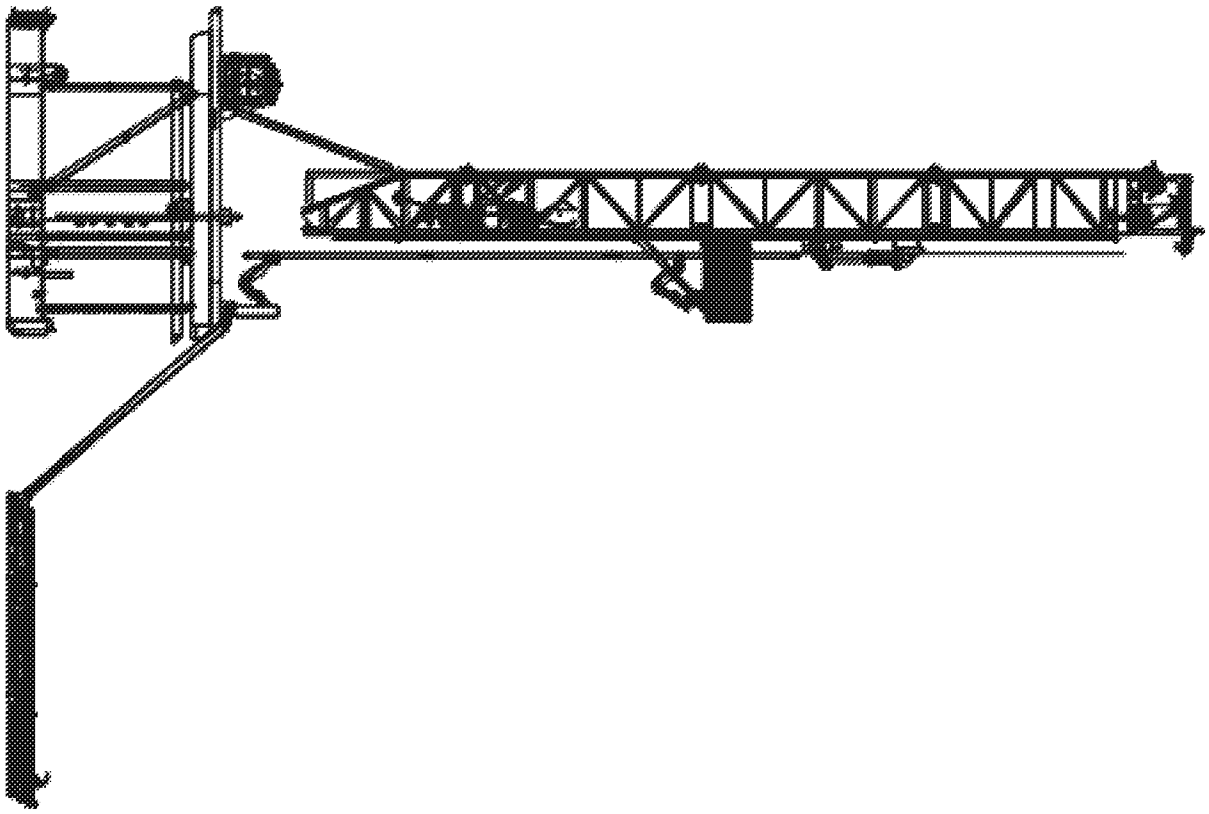
Figure 14:
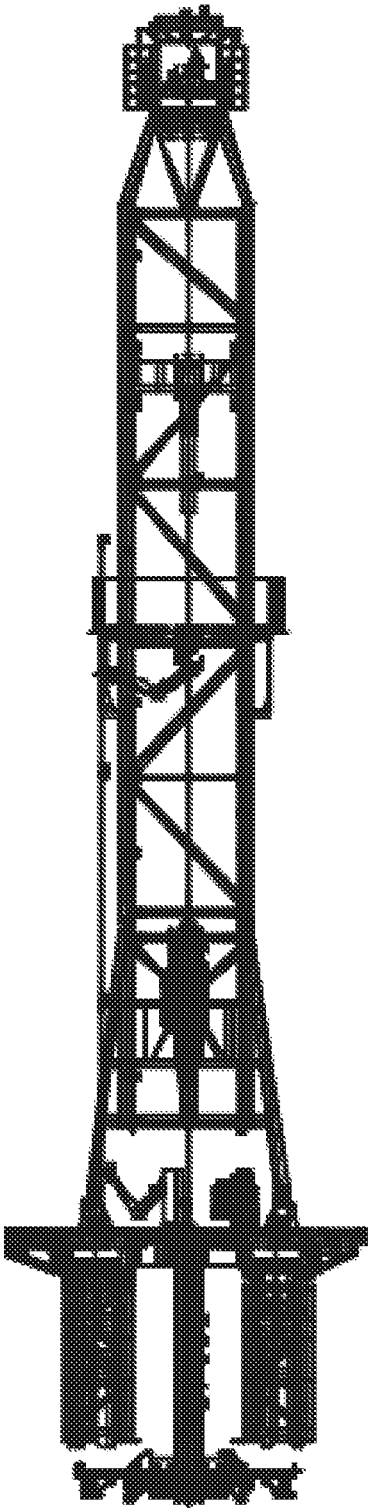
Figure 15:
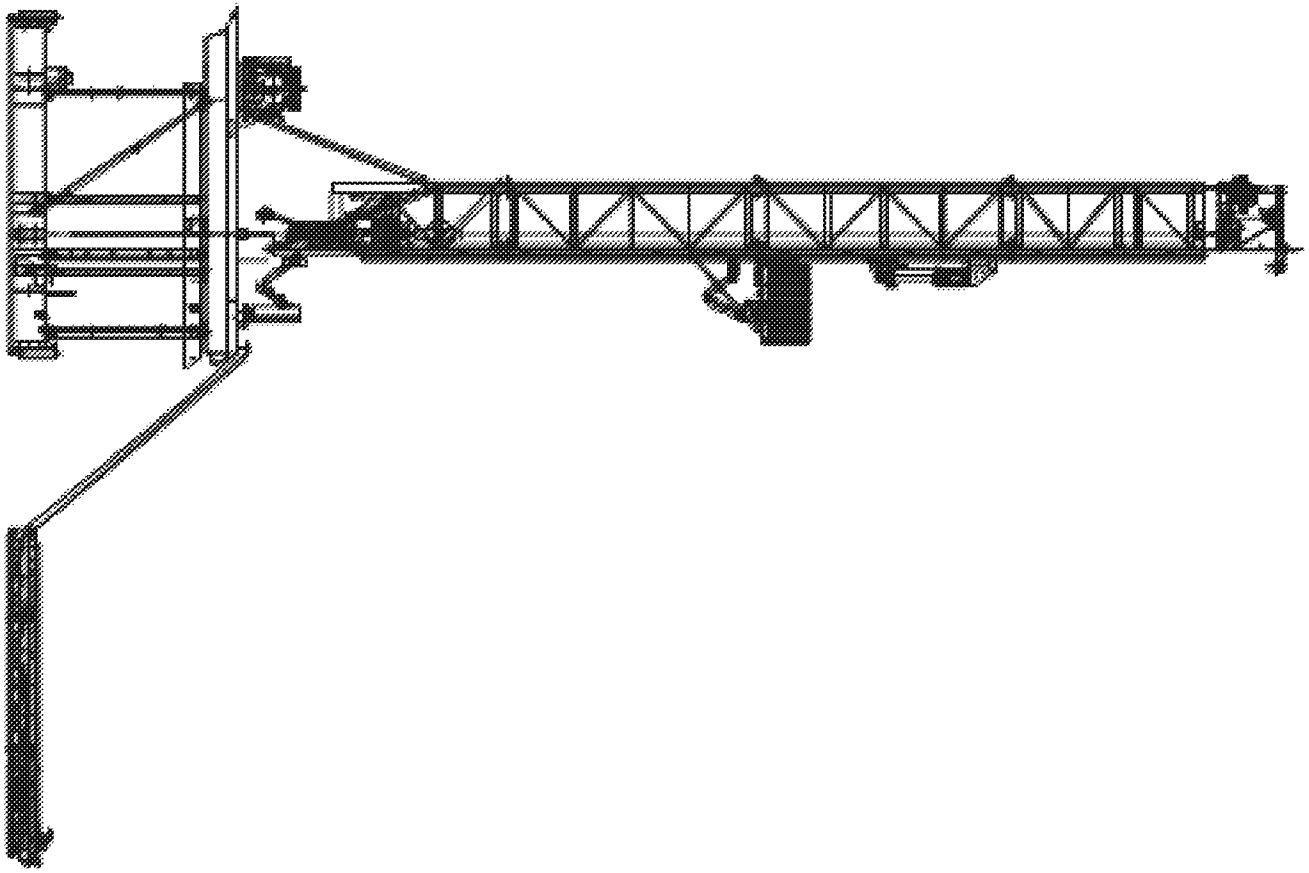

As shown in FIG. 7, the pipe racker (11) on the finger board may be arranged on the power finger board. The pipe racker (11) on the finger board may include a clamp head (11-1), a variable amplitude mechanism (11-2), a rotary mechanism (11-3), and a travelling mechanism (11-4). As used herein, the variable amplitude mechanism (11-2), the rotary mechanism (11-3), and the travelling mechanism (11-4) may be used as connection components between the clamp head (11-1) and the power finger board, which may drive the clamp head (11-1) to perform a specified movement in space. In some embodiments, the clamp head (11-1) may be used to clamp or support the pipe. When the pipe racker (11) on the finger board has a clamping function, a mechanism (e.g., a cylinder, a gear rack, or a ball screw) may be arranged between the variable amplitude mechanism (11-2) and the rotary mechanism (11-3), so that the clamp head (11-1) may rise and fall in the vertical direction.

Some embodiments of the present disclosure may also include a tripping out and tripping in method. The method may be implemented as shown in FIGS. 8 to 15. In some embodiments, an entire process of tripping out may be as follows.

In step 1, the top drive (8) may be placed at a low position. The elevator (8-1) may be opened to clamp a string of a well center. The elevator (8-1) may be shut. The string of the well center may be lifted upward.

In some embodiments, the string may be a pipe connecting with a drill bit, such as a drill rod, a stand, or the like.

In step 2, a power slip may be turned off after the top drive (8) arrives at a high position. The string may be placed on the power slip. That is, the power slip may be used to fix the string.

In step 3, the iron roughneck (5) may be extended to the well center to break out. An upper portion of the string may be fixed via the elevator (8-1) of the top drive (8).

In step 4, the iron roughneck (5) may be retracted. The pipe racker (11) on the finger board and the drill floor mechanical arm (6) may be extended to the well center, synchronously. A clamp head of the pipe racker (11) on the finger board may be opened to clamp or support an upper portion of a stand. A guide clamp (6-5) of the drill floor mechanical arm (6) may be opened to clamp or support a lower portion of the stand.

In some embodiments, a height of the pipe racker (11) on the finger board may be adjusted based on a length of the stand. In some embodiments, the clamp head of the pipe racker (11) on the finger board may be used to clamp or support at a position close to an upper end portion of the stand. In some embodiments, the clamp head (11-1) of the pipe racker (11) on the finger board may be used to clamp or support at a position of 0.2 to 1 meter from the upper end portion of the stand. In some embodiments, the drill floor mechanical arm (6) may be arranged on the base (1). The guide clamp (6-5) of the drill floor mechanical arm (6) may be used to clamp or support at a position close to a lower end portion of the stand. In some embodiments, the guide clamp (6-5) of the drill floor mechanical arm (6) may be used to clamp or support at a position of 0.2 to 1 meter from the lower end portion of the stand. The upper portion and the lower portion of the stand may be clamped or supported by two different mechanical arms on the drilling machine, which may vertically transport the stand, adapt stands with different lengths, and select an appropriate clamping or supporting position. During the transportation of the stand, an unnecessary shake may be avoided, thereby improving the stability and reliability of the operation.

In step 5, the elevator (8-1) of the top drive (8) may be opened. The elevator (8-1) may be tilted backward.

In step 6, the pipe racker (11) on the finger board and the drill floor mechanical arm (6) may be retracted, rotated, and moved synchronously to transport the stand to a region of at least one pipe setback. The stand may remain vertical during the transportation of the stand.

In step 7, the stand may be lowered to the region of the at least one pipe setback by the pipe racker (11) on the finger board or the drill floor mechanical arm (6). The clamp head of the pipe racker (11) on the finger board and the clamp head of the drill floor mechanical arm (6) (the clamp head (11-1) and the guide clamp (6-5)) may be opened and retracted, synchronously.

In step 8, the pipe racker (11) on the finger board and the drill floor mechanical arm (6) may be moved, rotated, or extended to a position close to the well center, synchronously, to wait for clamping a next stand.

During the steps 6-8, after the stand is out of the well center, the top drive (8) may be moved downward to the low position to perform the step 1 and continue to a next cycle.

The process of the tripping in may be the inverse of the process of the tripping out. In some embodiments, the drilling machine may further include a thread grease doper. The thread grease doper may be arranged on the drilling machine. For example, the thread grease doper may be integrated on the drill floor mechanical arm (6) or the iron roughneck (5). A thread grease may be doped in a process that the top drive moves downward, which is not repeated.

In some embodiments, the top drive (8) may include a telescopic mechanism. The telescopic mechanism may be used to control the top drive (8) to move in the horizontal surface. In some embodiments, in the process of tripping out and tripping in, when a stand is disconnected from a string of the well center or a stand is connected into a string of the well center, the telescopic mechanism may be used to control the top-drive (8) to move out from a position where the stand is located. Therefore, the top-drive (8) may synchronously perform the following steps and not wait at the position.

In some embodiments, the process of the tripping out may include the following steps.

In step 1, the top drive (8) may be placed at a low position. The elevator (8-1) may be opened to clamp a string of a well center. The elevator (8-1) may be shut. The string of the well center may be lifted upward.

In step 2, a power slip may be turned off. The string may be placed on the power slip after the top drive (8) arrives at a high position.

In step 3, the pipe racker (11) on the finger board and the drill floor mechanical arm (6) may be extended to the well center, synchronously. The clamp head (11-1) of the pipe racker (11) on the finger board may be opened to clamp or support an upper portion of a stand. The guide clamp (6-5) of the drill floor mechanical arm (6) may be opened to clamp or support a lower portion of the stand.

In step 4, the elevator (8-1) of the top drive (8) may be opened. The elevator (8-1) may be tilted backward. The telescopic mechanism may be used to control the top drive (8) to space a position where a string at the well center is located. The top drive (8) may be moved to a lower position. At the same time, the iron roughneck (5) may be extended to the well center to break out. The iron roughneck may be retracted after the breaking out.

In step 5, the pipe racker (11) on the finger board and the drill floor mechanical arm (6) may be retracted, rotated, and moved synchronously to transport the stand to the region of the at least one pipe setback. The stand may remain vertical during the transportation of the stand.

In step 6, the top drive (8) may be moved downward to the low position to repeat the step 1 and step 2. At the same time, the stand may be lowered to the region of the at least one pipe setback by the pipe racker (11) on the finger board or the drill floor mechanical arm (6). The clamp head of the pipe racker (11) on the finger board and the clamp head of the drill floor mechanical arm (6) (the clamp head (11-1) and the guide clamp (6-5)) may be opened and retracted, synchronously.

In step 7, the pipe racker (11) on the finger board and the drill floor mechanical arm (6) may be moved, rotated, or extended to a position close to the well center, synchronously, to wait for clamping a next stand.

In some embodiments, the process of the tripping in may be the inverse of the process of the tripping out, which is not repeated.

Some embodiments of the present disclosure may also include a method for connecting stands. The method may be implemented as shown in FIGS. 17 to 28. In some embodiments, an entire process may be as follows.

In step 1, a first pipe (e.g., a drill rod, a drill collar, a sleeve, etc.) may be obliquely transported to a drill floor (the upper surface of the upper seat (1-1)) via the power catwalk (12). A connector of the first pipe may be outside a main body of the power catwalk (12) to connect the stand-connecting mechanical arm (9) at the lower position. A clamp head (9-5) may be tilted to be parallel to an axis of the first pipe. The clamp head (9-5) may be opened to clamp a front portion of the first pipe.

In step 2, the first pipe may be carried to move upward by the stand-connecting mechanical arm (9). The first pipe may be tilted from horizontal or slant to vertical by adjusting the clamp head (9-5) and the variable amplitude mechanism (9-4).

In some embodiments, the first pipe may be directly carried to move upward by the stand-connecting mechanical arm (9) to adjust the first pipe to vertical. In some embodiments, in order to avoid sloshing during the transportation of the first pipe, when the first pipe is carried to move upward by the stand-connecting mechanical arm (9), the first pipe may be clamped by the drill floor mechanical arm (6) to adjust the first pipe to vertical.

In step 3, a clamp head of the stand-connecting mechanical arm (9) may rotate clockwise at a first angle along a vertical axis to a position right above the mouse hole A (7-1). The first pipe may be carried to move downward and placed into the mouse hole A (7-1).

The step 1 and the step 2 may be repeated to clamp a second pipe.

In step 4, the clamp head (9-5) of the stand-connecting mechanical arm (9) may rotate counterclockwise at a second angle along the vertical axis to a position right above the mouse hole B (7-2). The second pipe may be carried to move downward and placed into the mouse hole B (7-2).

The step 1 and the step 2 may be repeated to clamp a third pipe.

In step 5, the clamp head (9-5) of the stand-connecting mechanical arm (9) may rotate clockwise at the first angle or counterclockwise at the second angle along the vertical axis to the position right above the mouse hole A (7-1) or the mouse hole B (7-2). The third pipe may be carried to move downward. A connector at a lower portion of the third pipe may be placed into a connector at an upper portion of the first pipe or the second pipe.

In step 6, the iron roughneck (5) may be extended to the mouse hole (the mouse hole A (7-1) or the mouse hole B (7-2)) including two pipes to make up the two pipes to form a double stand. The iron roughneck (5) may be retracted after making up the two pipes.

In step 7, the double stand may be clamped, by the stand-connecting mechanical arm (9), to move upward until a lower end of the double stand is higher than the drill floor. The stand-connecting mechanical arm (9) may be synchronously moved to a position right above the other pipe in the other mouse hole. The double stand may be lowered downward until a connector at the lower portion of the double stand is placed into a connector at an upper portion of the other pipe. The clamp head (6-5) of the drill floor mechanical arm (6) may support the lower portion of the double stand before the connector at the lower portion of the double stand leaves the drill floor.

In step 8, the iron roughneck (5) may be extended to the mouse hole including three pipes to make up the double stand and the other pipe to form a triple stand. The iron roughneck (5) may be retracted after making up the double stand and the other pipe.

In step 9, the triple stand may be clamped, by the stand-connecting mechanical arm (9), to move upward until a connector at a lower portion of the triple stand leaves the drill floor. The clamp head (6-5) of the drill floor mechanical arm (6) may support the lower portion of the triple stand before the connector at the lower portion of the triple stand leaves the drill floor.

In step 10, an upper portion of the triple stand may be clamped or supported by the pipe racker (11) on the finger board. The clamp head of the stand-connecting mechanical arm (9) may be opened and driven to move upward. A lower portion of the triple stand may be clamped or supported by the drill floor mechanical arm (6).

In step 11, the triple stand may be vertically transported, by the pipe racker on the finger board (11) and the drill floor mechanical arm (6), to the region of the at least one pipe setback, synchronously.

In step 12, the triple stand may be lowered, by the pipe racker (11) on the finger board or the drill floor mechanical arm (6), to the region of the at least one pipe setback. The clamp head of the pipe racker (11) on the finger board and the clamp head of the drill floor mechanical arm (6) (the clamp head (11-1) and the guide clamp (6-5)) may be opened and retracted, synchronously. The drill floor mechanical arm (6) may be returned to a storage region.

Steps 1-12 may be repeated to circularly connect a next triple stand offline. In some embodiments, the drilling machine may further include a thread grease doper. The thread grease doper may be arranged on the drilling machine. For example, during a process for connecting stands, the thread grease doper may be integrated into the iron roughneck (5) or the drill floor mechanical arm (6) to dope a thread grease.

The method for connecting a double stand offline may be a simplification of the above method, which is not repeated.

Some embodiments of the present disclosure may also include a method for connecting a quadruple stand using two mouse holes through the stand-connecting mechanical arm (9). The process may be as follows.

In step 1, a first pipe (e.g., a drill rod, a drill collar, a sleeve, etc.) may be obliquely transported to a drill floor (the upper surface of the upper seat (1-1)) via the power catwalk (12). A connector of the first pipe may be outside the main body of the power catwalk (12) to connect the stand-connecting mechanical arm (9) at the lower position. A clamp head (9-5) may be tilted to be parallel to an axis of the first pipe. The clamp head (9-5) may be opened to clamp a front portion of the first pipe.

In step 2, the first pipe may be carried to move upward by the stand-connecting mechanical arm (9). The first pipe may be tilted from horizontal or slant to vertical by adjusting the clamp head (9-5) and the variable amplitude mechanism (9-4).

In some embodiments, the first pipe may be directly carried to move upward by the stand-connecting mechanical arm (9) to adjust the first pipe to vertical. In some embodiments, in order to avoid sloshing during transporting the first pipe, when the first pipe is carried to move upward by the stand-connecting mechanical arm (9), the first pipe may be clamped by the drill floor mechanical arm (6) to adjust the first pipe to vertical.

In step 3, a clamp head of the stand-connecting mechanical arm (9) may rotate clockwise at a first angle along a vertical axis to a position right above the mouse hole A (7-1). The first pipe may be carried to move downward and placed into the mouse hole A (7-1).

The step 1 and the step 2 may be repeated to clamp a second pipe.

In step 4, the clamp head (9-5) of the stand-connecting mechanical arm (9) may rotate counterclockwise at a second angle along the vertical axis to a position right above the mouse hole B (7-2). The second pipe may be carried to move downward and placed into the mouse hole B (7-2).

The step 1 and the step 2 may be repeated to clamp a third pipe.

In step 5, the clamp head (9-5) of the stand-connecting mechanical arm (9) may rotate clockwise at the first angle or counterclockwise at the second angle along the vertical axis to the position right above the mouse hole A (7-1) or the mouse hole B (7-2). The third pipe may be carried to move downward. A connector at a lower portion of the third pipe may be placed into a connector at an upper portion of the first pipe or the second pipe.

In step 6, the iron roughneck (5) may be extended to the mouse hole (the mouse hole A (7-1) or the mouse hole B (7-2)) including two pipes to make up the two pipes to form a first double stand. The iron roughneck (5) may be retracted after making up the two pipes.

In step 7, the first double stand in the mouse hole (the mouse hole A (7-1) or the mouse hole B (7-2)) may be clamped, by the stand-connecting mechanical arm (9), to move downward until a connector at an upper portion of the first double stand is exposed from the mouse hole A (7-1) or the mouse hole B (7-2).

The step 1 and the step 2 may be repeated to clamp a fourth pipe.

In step 8, the clamp head (9-5) of the stand-connecting mechanical arm (9) may rotate clockwise at the first angle or counterclockwise at the second angle along the vertical axis to the position right above the mouse hole A (7-1) or the mouse hole B (7-2) which includes a single pipe. The fourth pipe may be carried to move downward. A connector at a lower portion of the fourth pipe may be placed into a connector at an upper portion of the single pipe.

In step 9, the iron roughneck (5) may be extended to the mouse hole (the mouse hole A (7-1) or the mouse hole B (7-2)) including two pipes to make up the two pipes to form a second double stand. The iron roughneck (5) may be retracted after making up the two pipes.

In step 10, the second double stand may be clamped, by the stand-connecting mechanical arm (9), to move upward until a connector at a lower portion of the second double stand is higher than the drill floor. The stand-connecting mechanical arm (9) may be synchronously moved to a position right above the first double stand in the other mouse hole. The second double stand may be lowered downward until a connector at the lower portion of the second double stand is placed into a connector at an upper portion of the first double stand. The clamp head (6-5) of the drill floor mechanical arm (6) may support the lower portion of the second double stand before the connector at the lower portion of the second double stand leaves the drill floor.

In step 11, the iron roughneck (5) may be extended to the mouse hole placing the first double stand and the second double stand to make up the first double stand and the second double stand to form a quadruple stand. The iron roughneck (5) may be retracted after making up the two pipes.

In step 12, the quadruple stand may be clamped, by the stand-connecting mechanical arm (9), to move upward until a connector at a lower portion of the quadruple stand leaves the drill floor with a certain height. The clamp head (6-5) of the drill floor mechanical arm (6) may support the lower portion of the quadruple stand before the connector at the lower portion of the quadruple stand leaves the drill floor.

In step 13, an upper portion of the quadruple stand may be clamped or supported by the pipe racker (11) on the finger board. The clamp head of the stand-connecting mechanical arm (9) may be opened and driven to move upward. A lower portion of the quadruple stand may be clamped or supported by the drill floor mechanical arm (6).

In step 14, the quadruple stand may be vertically transported, by the pipe racker on the finger board (11) and the drill floor mechanical arm (6), to the region of the at least one pipe setback, synchronously.

In step 15, the quadruple stand may be lowered, by the pipe racker (11) on the finger board or the drill floor mechanical arm (6), to the region of the at least one pipe setback. The clamp head of the pipe racker (11) on the finger board and the clamp head of the drill floor mechanical arm (6) (the clamp head (11-1) and the guide clamp (6-5)) may be opened and retracted, synchronously. The drill floor mechanical arm (6) may be returned to a storage region.

Steps 1-15 may be repeated to circularly connect a next quadruple stand offline. In some embodiments, the drilling machine may further include a thread grease doper. The thread grease doper may be arranged on the drilling machine. For example, during a process for connecting stands, the thread grease doper may be integrated into the iron roughneck (5) or the drill floor mechanical arm (6) to dope a thread grease.

Some embodiments of the present disclosure may also include another method for connecting a quadruple stand using two mouse holes through the stand-connecting mechanical arm (9). The process may be as follows.

In step 1, a first pipe (e.g., a drill rod, a drill collar, a sleeve, etc.) may be obliquely transported to a drill floor (the upper surface of the upper seat (1-1)) via the power catwalk (12). A connector of the first pipe may be outside the main body of the power catwalk (12) to connect the stand-connecting mechanical arm (9) at the lower position. A clamp head (9-5) may be tilted to be parallel to an axis of the first pipe. The clamp head (9-5) may be opened to clamp a front portion of the first pipe.

In step 2, the first pipe may be carried to move upward by the stand-connecting mechanical arm (9). The first pipe may be tilted from horizontal or slant to vertical by adjusting the clamp head (9-5) and the variable amplitude mechanism (9-4).

In some embodiments, the first pipe may be directly carried to move upward by the stand-connecting mechanical arm (9) to adjust the first pipe to vertical. In some embodiments, in order to avoid sloshing during transporting the first pipe, when the first pipe is carried to move upward by the stand-connecting mechanical arm (9), the first pipe may be clamped by the drill floor mechanical arm (6) to adjust the first pipe to vertical.

In step 3, a clamp head of the stand-connecting mechanical arm (9) may rotate clockwise at a first angle along a vertical axis to a position right above the mouse hole A (7-1). The first pipe may be carried to move downward and placed into the mouse hole A (7-1).

The step 1 and the step 2 may be repeated to clamp a second pipe.

In step 4, the clamp head (9-5) of the stand-connecting mechanical arm (9) may rotate counterclockwise at a second angle along the vertical axis to a position right above the mouse hole B (7-2). The second pipe may be carried to move downward and placed into the mouse hole B (7-2).

The step 1 and the step 2 may be repeated to clamp a third pipe.

In step 5, the clamp head (9-5) of the stand-connecting mechanical arm (9) may rotate clockwise at the first angle or counterclockwise at the second angle along the vertical axis to the position right above the mouse hole A (7-1) or the mouse hole B (7-2). The third pipe may be carried to move downward. A connector at a lower portion of the third pipe may be placed into a connector at an upper portion of the first pipe or the second pipe.

In step 6, the iron roughneck (5) may be extended to the mouse hole (the mouse hole A (7-1) or the mouse hole B (7-2)) including two pipes to make up the two pipes to form a double stand. The iron roughneck (5) may be retracted after making up the two pipes.

In step 7, the double stand may in the mouse hole (the mouse hole A (7-1) or the mouse hole B (7-2)) be clamped, by the stand-connecting mechanical arm (9), to move downward until a connector at an upper portion of the double stand is exposed from the mouse hole A (7-1) or the mouse hole B (7-2).

The step 1 and the step 2 may be repeated to clamp a fourth pipe.

In step 8, the clamp head (9-5) of the stand-connecting mechanical arm (9) may rotate clockwise at the first angle or counterclockwise at the second angle along the vertical axis to the position right above the mouse hole A (7-1) or the mouse hole B (7-2) including the double pipe. The fourth pipe may be carried to move downward. A connector at a lower portion of the fourth pipe may be placed into a connector at an upper portion of the double pipe.

In step 9, the iron roughneck (5) may be extended to the mouse hole (the mouse hole A (7-1) or the mouse hole B (7-2)) including the double pipe and the fourth pipe to make up the double pipe and the fourth pipe to form a triple stand. The iron roughneck (5) may be retracted after making up the double pipe and the fourth pipe.

In step 10, the triple stand may be clamped, by the stand-connecting mechanical arm (9), to move upward until a connector at a lower portion of the triple stand is higher than the drill floor. The stand-connecting mechanical arm (9) may be synchronously moved to a position right above the single pipe in the other mouse hole. The triple stand may be lowered downward until a connector at the lower portion of the triple stand is placed into a connector at an upper portion of the single pipe. The clamp head (6-5) of the drill floor mechanical arm (6) may support the lower portion of the triple stand before the connector at the lower portion of the triple stand leaves the drill floor.

In step 11, the iron roughneck (5) may be extended to the mouse hole including the triple stand and the single pipe to make up the triple stand and the single pipe to form a quadruple stand. The iron roughneck (5) may be retracted after making up the triple stand and the single pipe.

In step 12, the quadruple stand may be clamped, by the stand-connecting mechanical arm (9), to move upward until a connector at a lower portion of the quadruple stand leaves the drill floor. The clamp head (6-5) of the drill floor mechanical arm (6) may support the lower portion of the quadruple stand before the connector at the lower portion of the quadruple stand leaves the drill floor.

In step 13, an upper portion of the quadruple stand may be clamped or supported by the pipe racker (11) on the finger board. The clamp head of the stand-connecting mechanical arm (9) may be opened and driven to move upward. A lower portion of the quadruple stand may be clamped or supported by the drill floor mechanical arm (6).

In step 14, the quadruple stand may be vertically transported, by the pipe racker on the finger board (11) and the drill floor mechanical arm (6), to the region of the at least one pipe setback, synchronously.

In step 15, the quadruple stand may be lowered, by the pipe racker (11) on the finger board or the drill floor mechanical arm (6), to the region of the at least one pipe setback. The clamp head of the pipe racker (11) on the finger board and the clamp head of the drill floor mechanical arm (6) (the clamp head (11-1) and the guide clamp (6-5)) may be opened and retracted, synchronously. The drill floor mechanical arm (6) may be returned to a storage region.

Steps 1-15 may be repeated to circularly connect a next quadruple stand offline. In some embodiments, the drilling machine may further include a thread grease doper. The thread grease doper may be arranged on the drilling machine. For example, during a process for connecting stands, the thread grease doper may be integrated into the iron roughneck (5) or the drill floor mechanical arm (6) to dope a thread grease.

In some embodiments, the drilling machine may be used to connect stands with any length by using two mouse holes through two stand-connecting mechanical arms. The length of the stand may be set according to task requirements of the drill rod. In some embodiments, the length of a connected stand may include five stands. The steps for connecting five stands may be described in an exemplary flow 100. In some embodiments, the process 100 may be as follows.

In S110, a first pipe and a second pipe may be transported via a power catwalk. The first pipe and the second pipe may be clamped and adjusted to vertical by a stand-connecting mechanical arm.

In some embodiments, the first tube (e.g., the drill rod, the drill collar, the sleeve, etc.) and the second pipe may be obliquely transported to a drill floor via the power catwalk (12). The first pipe and the second pipe may be clamped by the stand-connecting mechanical arm.

In some embodiments, the first tube and the second pipe may be transported via the power catwalk (12), synchronously. The first pipe and the second pipe may be clamped by a first stand-connecting mechanical arm and a second stand-connecting mechanical arm, respectively. In some embodiments, one pipe may be transported once via the power catwalk (12). One of the two stand-connecting mechanical arms may clamp the stand to perform the subsequent operations. When the pipe is removed, another pipe may be transported to the drill floor via the power catwalk (12). Another of the two stand-connecting mechanical arms may clamp the stand to perform the subsequent operations.

In some embodiments, when the pipe is transported to the drill floor, a connector of the pipe may be outside the main body of the power catwalk (12). When one of the two stand-connecting mechanical arms clamps the stand, the stand-connecting mechanical arm may be located at a lower position. A clamp head of the stand-connecting mechanical arm may be tilted to be parallel to an axis of the first pipe. The clamp head may be opened to clamp a front portion of the pipe.

In some embodiments, the pipe may be directly carried to move upward by the stand-connecting mechanical arm to adjust the pipe to vertical. In some embodiments, in order to avoid sloshing during transporting the pipe, when the pipe is carried to move upward by the stand-connecting mechanical arm, the pipe may be clamped by the drill floor mechanical arm to adjust the pipe to vertical.

In some embodiments, the first pipe and the second pipe may be clamped by the first stand-connecting mechanical arm and the second stand-connecting mechanical arm to adjust the first pipe and the second pipe to vertical, respectively.

In S121, the first pipe may be placed into the mouse hole A by the first stand-connecting mechanical arm.

In some embodiments, the clamp head of the first stand-connecting mechanical arm may be rotated clockwise at a first angle along the vertical axis to a position right above the mouse hole A. The first pipe may be carried to move downward and placed into the mouse hole A.

In S122, the second pipe may be placed into the mouse hole B by the second stand-connecting mechanical arm.

In some embodiments, the clamp head of the second stand-connecting mechanical arm may be rotated counterclockwise at a second angle along the vertical axis to a position right above the mouse hole B. The second pipe may be carried to move downward and placed into the mouse hole B.

In some embodiments, operation S121 and operation S122 may be performed simultaneously. In some embodiments, operation S121 and operation S122 may be performed in order.

In S130, a third pipe may be transported via the power catwalk. The third pipe may be clamped and adjusted to vertical by the first stand-connecting mechanical arm.

In some embodiments, the third pipe may be transported to the drill floor via the power catwalk (12). After the first pipe is placed in the mouse hole A by the first stand-connecting mechanical arm, the first stand-connecting mechanical arm may be moved to the power catwalk (12) to clamp the third pipe. In some embodiments, the third pipe may be directly carried to move upward by the first stand-connecting mechanical arm to adjust to vertical from horizontal or slant by adjusting the clamp head and the variable amplitude mechanism. In some embodiments, in order to avoid sloshing during transporting the third pipe, when the third pipe is carried to move upward by the first stand-connecting mechanical arm, the third pipe may be clamped by the drill floor mechanical arm (6) to adjust the third pipe to vertical.

In S140, the third pipe may be transported to the mouse hole A or the mouse hole B by the first stand-connecting mechanical arm. The third pipe may be connected to the first pipe or the second pipe to form a double stand.

In some embodiments, the clamp head of the first stand-connecting mechanical arm may rotate clockwise at the first angle or counterclockwise at the second angle along the vertical axis to the position right above the mouse hole A or the mouse hole B. The third pipe may be carried to move downward. A connector at a lower portion of the third pipe may be placed into a connector at an upper portion of the first pipe or the second pipe.

In some embodiments, the iron roughneck (5) may be extended to the mouse hole A or the mouse hole B including two pipes to make up the two pipes to form the double stand. The iron roughneck (5) may be retracted after making up the two pipes.

In S150, the fourth pipe may be transported via the power catwalk. The fourth pipe may be clamped and adjusted to vertical by the second stand-connecting mechanical arm.

In some embodiments, the fourth pipe may be transported to the drill floor via the power catwalk (12). After the second pipe is placed in the mouse hole B by the second stand-connecting mechanical arm, the second stand-connecting mechanical arm may be moved to the power catwalk (12) to clamp the fourth pipe. In some embodiments, the fourth pipe may be directly carried to move upward by the second stand-connecting mechanical arm to adjust to vertical from horizontal or slant by adjusting the clamp head and the variable amplitude mechanism. In some embodiments, in order to avoid sloshing during transporting the fourth pipe, when the fourth pipe is carried to move upward by the second stand-connecting mechanical arm, the fourth pipe may be clamped by the drill floor mechanical arm (6) to adjust the fourth pipe to vertical.

In some embodiments, operation S150 and operation S140 may be performed simultaneously. In some embodiments, operation S150 and operation S140 may be performed in order.

In S161, the double pipe may be transported to the mouse hole A or the mouse hole B by the first stand-connecting mechanical arm. The double pipe may be connected to the first pipe or the second pipe to form a triple stand.

In some embodiments, the double stand may be clamped, by the first stand-connecting mechanical arm, to move upward until a connector at a lower portion of the double stand is higher than the drill floor with a certain height. The first stand-connecting mechanical arm may be synchronously moved to a position right above the pipe in the other mouse hole. The double stand may be lowered downward until a connector at the lower portion of the double stand is placed into a connector at an upper portion of the pipe. The clamp head of the drill floor mechanical arm may support the lower portion of the double stand before the connector at the lower portion of the double stand leaves the drill floor.

In some embodiments, the iron roughneck (5) may be extended to a position above the mouse hole including three pipes to make up the double stand and the single pipe to form a triple stand. The iron roughneck may be retracted after making up the double stand and the single pipe.

In S162, the fourth pipe may be transported to the mouse hole A or the mouse hole B by the second stand-connecting mechanical arm.

In some embodiments, when the double stand is removed from the mouse hole A or the mouse hole B by the second stand-connecting mechanical arm, the fourth pipe may be placed into a space hole of the mouse hole A or the mouse hole B by the second stand-connecting mechanical arm.

In S171, the triple stand may be transported to the mouse hole A or the mouse hole B by the first stand-connecting mechanical arm. The triple stand and the fourth pipe may be connected to form a quadruple stand.

In some embodiments, when the fourth pipe is placed into a space hole of the mouse hole A or the mouse hole B by the second stand-connecting mechanical arm, the second stand-connecting mechanical arm may be moved from the mouse hole. Then, the triple stand may be transported to the mouse hole via the first stand-connecting mechanical arm. During the transportation of the triple stand, the triple stand may be clamped, by the first stand-connecting mechanical arm, to move upward until a connector at a lower portion of the triple stand is higher than the drill floor with a certain height. The first stand-connecting mechanical arm may be synchronously moved to a position right above the fourth pipe in the mouse hole where the fourth pipe is located. The triple stand may be lowered downward until a connector at the lower portion of the triple stand is placed into a connector at an upper portion of the fourth pipe. The clamp head of the drill floor mechanical arm may support the lower portion of the triple stand before the connector at the lower portion of the triple stand leaves the drill floor. The iron roughneck (5) may be extended to the mouse hole including four pipes to make up the triple stand and the fourth pipe to form the quadruple stand. The iron roughneck may be retracted after making up the triple stand and the fourth pipe.

In S172, the fifth pipe may be transported via the power catwalk. The fifth pipe may be clamped by the second stand-connecting mechanical arm and placed into the mouse hole A or the mouse hole B.

In some embodiments, when the fifth pipe is placed into a space hole of the mouse hole A or the mouse hole B by the second stand-connecting mechanical arm, the second stand-connecting mechanical arm may be moved from the mouse hole to the power catwalk (12). After the fifth pipe is transported to the drill floor via the power catwalk (12), the fifth pipe may be clamped by the second stand-connecting mechanical arm. After the fifth pipe is adjusted to vertical, the fifth pipe may be transported to a space hole of the mouse hole A or the mouse hole B and placed into the mouse hole.

In S180, the quadruple stand may be transported to the mouse hole A or the mouse hole B by the first stand-connecting mechanical arm. The quadruple stand may be connected to the fifth pipe to form a quintuple stand.

In some embodiments, the operation of operation S180 may be similar to operation S171, which is not repeated.

In some embodiments, when the operation S180 is completed, the connected quintuple stand may be transported to the at least one pipe setback to store by the first stand-connecting mechanical arm or the second stand-connecting mechanical arm. In some embodiments, the transportation of the quintuple stand may be similar to the transportation of the double stand or the triple stand. More descriptions regarding the transportation may be found elsewhere in the present disclosure, which is not repeated.

The descriptions of the process 100 described above are merely for illustration and description, without limiting the scope of one or more embodiments of the present disclosure. In some embodiments, in the above process, the functions performed by the first stand-connecting mechanical arm and the second stand-connecting mechanical arm may be interchanged. In some embodiments, some operations may be merged or adjusted. For example, operation S121 and operation S122 may be merged into one operation. As another example, operation S150 may be performed after operation S140. Alternative, operation S150 and operation S140 may also be performed simultaneously.

By disposing two stand-connecting mechanical arms, connecting stands with any length may be implemented by using two mouse holes. There may be no need to open more mouse holes on the base (1) when a plurality of stands are connected, which may effectively save operation space on the base (1) and make a structure of the drilling machine more compact. Further, by disposing two stand-connecting mechanical arms, a next pipe to be connected may be transported during the process for connecting stands, which may effectively improve the operational efficiency of connecting the plurality of stands.

We claim:

1. A drilling machine, comprising:

a base;

a mast arranged on the base;

an iron roughneck;

a power slip;

a drill floor mechanical arm arranged on the base;

a top drive and a power finger board arranged on the mast;

a pipe racker on a finger board arranged on the power finger board; and an elevator arranged on the top drive, wherein the elevator is configured to tilt relative to a vertical direction, a region of at least one pipe setback is disposed on a region in an upper surface of the base vertically corresponding to the power finger board, the pipe racker on the finger board includes a clamp head and a transmission mechanism that moves the clamp head, the clamp head being configured to clamp or support an upper portion of a stand, the drill floor mechanical arm is configured to clamp or support a lower portion of the stand and coordinate with the clamp head to move the stand between a position of a well center and the region of the at least one pipe setback, and during the movement of the stand between the position of the well center and the region of the at least one pipe setback, one of the clamp head and the drill floor mechanical arm clamps the stand and the other of the clamp head and the drill floor mechanical arm supports the stand.

2. The drilling machine of claim 1, further comprising a stand-connecting mechanical arm and a power catwalk, wherein the stand-connecting mechanical arm is arranged on the mast and configured to move up-and-down along the mast, clamping and driving a pipe to move; and the power catwalk is arranged on the ground and a mouse hole A and a mouse hole B that are disposed on the base, the mouse hole A and the mouse hole B being positioned between the at least one pipe setback and the well center.

3. The drilling machine of claim 2, wherein a thread grease doper is arranged on the drilling machine.

4. The drilling machine of claim 1, wherein the drill floor mechanical arm includes:

a rail disposed on the base, the rail being disposed between the at least one pipe setback to form an L-shape;

a travelling mechanism arranged on the rail;

a string arranged on the travelling mechanism;

a telescopic mechanism arranged on the string; and a guide clamp arranged on the telescopic mechanism.

5. The drilling machine of claim 4, wherein the drilling machine further includes a mouse hole A and a mouse hole B disposed on the base, the mouse hole A and the mouse hole B being positioned between the at least one pipe setback and the well center, symmetrical to a center line of the rail.

6. A tripping out method using the drilling machine of claim 1, comprising:

step 1: placing the top drive at a low position, opening the elevator to clamp a string of the well center, shutting the elevator, and lifting the string of the well center upward;

step 2: turning off the power slip and placing the string on the power slip after the top drive arrives at a high position;

step 3: extending the iron roughneck to the well center to break out, and fixing an upper portion of the string via the elevator of the top drive;

step 4: retracting the iron roughneck, extending the pipe racker on the finger board and the drill floor mechanical arm to the well center, synchronously, opening the clamp head of the pipe racker on the finger board to clamp or support an upper portion of a stand, and opening a clamp head of the drill floor mechanical arm to clamp or support a lower portion of the stand;

step 5: opening the elevator of the top drive, and tilting the elevator backward;

step 6: retracting, rotating, and moving the pipe racker on the finger board and the drill floor mechanical arm, synchronously, to transport the stand to the region of the at least one pipe setback, the stand remaining vertical during the transportation of the stand;

step 7: lowering, by the pipe racker on the finger board or the drill floor mechanical arm, the stand to the region of the at least one pipe setback, opening and retracting the clamp head of the pipe racker on the finger board and the clamp head of the drill floor mechanical arm, synchronously; and step 8: moving, rotating, or extending the pipe racker on the finger board and the drill floor mechanical arm to a position close to the well center, synchronously, to wait for clamping a next stand.

7. The method of claim 6, further comprising:

during the steps 6-8, after the stand is out of the well center, moving the top drive downward to the low position to perform the step 1 and continue to a next cycle.

8. A tripping in method of the drilling machine of claim 3, comprising:

step 1: clamping, by one of the pipe racker on the finger board and the drill floor mechanical arm, and supporting, by the other of the pipe racker on the finger board and the drill floor mechanical arm, a stand to transport the stand to the position of the well center, during the transportation of the stand, the stand remaining vertical and the thread grease doper being used to dope a thread grease;

step 2: placing, by the pipe racker on the finger board and the drill floor mechanical arm, the stand on a top end of a lower string, lifting the stand by the elevator, loosening the stand by the pipe racker on the finger board and the drill floor mechanical arm, and moving the pipe racker on the finger board and the drill floor mechanical arm to the region of the at least one pipe setback to prepare to clamp a next stand;

step 3: extending the iron roughneck to the well center to make up and resetting the iron roughneck; and step 4: lowering, by the elevator, the stand to the lower position, turning off the power slip, opening the elevator to tilt backward, and moving the top drive upward.

9. The method of claim 8, wherein the thread grease doper is used to dope the thread grease on a lower portion of the stand during the transportation of the stand.

10. The method of claim 8, wherein the thread grease doper is used to dope the thread grease on a top portion of the stand during the transportation of the stand.

11. A method for connecting stands offline using the drilling machine of claim 2, comprising:

step 1: obliquely transporting a first pipe to a drill floor via the power catwalk, clamping a front portion of the first pipe using a clamp head of the stand-connecting mechanical arm, carrying the first pipe to move upward and adjusting the first pipe to vertical by the stand-connecting mechanical arm, moving the clamp head of the stand-connecting mechanical arm to a position right above the mouse hole A, carrying the first pipe downward and placing the first pipe into the mouse hole A by the stand-connecting mechanical arm;

step 2: obliquely transporting a second pipe to the drill floor via the power catwalk, clamping a front portion of the second pipe using the clamp head of the stand-connecting mechanical arm, carrying the second pipe to move upward and adjusting the second pipe to vertical by the stand-connecting mechanical arm, moving the clamp head of the stand-connecting mechanical arm to the position right above the mouse hole A, carrying the second pipe downward, and placing a connector at a lower portion of the second pipe into a connector at an upper portion of the first pipe;

step 3: extending the iron roughneck to the mouse hole A to make up the first pipe and the second pipe to form a double stand, retracting the iron roughneck after making up the first pipe and the second pipe;

step 4: clamping, by the stand-connecting mechanical arm, the double stand to move upward until a connector at a lower portion of the double stand leaves the drill floor, wherein a clamp head of the drill floor mechanical arm supports the lower portion of the double stand before the connector at the lower portion of the double stand leaves the drill floor;

step 5: clamping or supporting an upper portion of the double stand by the pipe racker on the finger board, opening the clamp head of the stand-connecting mechanical arm and driving the clamp head of the stand-connecting mechanical arm to move upward, clamping or supporting a lower portion of the double stand by the drill floor mechanical arm;

step 6: vertically transporting, by the pipe racker on the finger board and the drill floor mechanical arm, the double stand to the region of the at least one pipe setback, synchronously;

step 7: lowering, by the pipe racker on the finger board or the drill floor mechanical arm, the double stand to the region of the at least one pipe setback, opening and retracting the clamp head of the pipe racker on the finger board and a clamp head of the drill floor mechanical arm, synchronously, returning the drill floor mechanical arm to a storage region.

12. The method of claim 11, wherein when a plurality of pipes need to be connected, the method further includes:

repeating the steps of claim 11 to circularly connect a next double stand offline.

13. The method of claim 11, wherein the drilling machine further includes a thread grease doper, wherein the method further comprises: during a process for connecting stands, the thread grease doper is integrated into the iron roughneck or the drill floor mechanical arm to dope a thread grease.

14. A method for connecting stands offline using the drilling machine of claim 2, comprising:

step 1: obliquely transporting a first pipe to a drill floor via the power catwalk, clamping a front portion of the first pipe using a clamp head of the stand-connecting mechanical arm, carrying the first pipe to move upward and adjusting the first pipe to vertical by the stand-connecting mechanical arm, moving the clamp head of the stand-connecting mechanical arm to a position right above the mouse hole A, carrying the first pipe downward and placing the first pipe into the mouse hole A by the stand-connecting mechanical arm;

step 2: obliquely transporting a second pipe to the drill floor via the power catwalk, clamping a front portion of the second pipe using the clamp head of the stand-connecting mechanical arm, carrying the second pipe to move upward and adjusting the second pipe to vertical by the stand-connecting mechanical arm, moving the clamp head of the stand-connecting mechanical arm to a position right above the mouse hole B, carrying the second pipe downward, and placing the second pipe into the mouse hole B by the stand-connecting mechanical arm;

step 3: obliquely transporting a third pipe to the drill floor via the power catwalk, clamping a front portion of the third pipe using the clamp head of the stand-connecting mechanical arm, carrying the third pipe to move upward and adjusting the third pipe to vertical by the stand-connecting mechanical arm, moving the clamp head of the stand-connecting mechanical arm to the position right above the mouse hole A or the mouse hole B, carrying the third pipe downward, and placing a connector at a lower portion of the third pipe into a connector at an upper portion of the first pipe or the second pipe;

step 4: extending the iron roughneck to the mouse hole including two pipes to make up the two pipes to form a double stand, and retracting the iron roughneck after making up the two pipes;

step 5: clamping, by the stand-connecting mechanical arm, the double stand to move upward until a lower end of the double stand is higher than the drill floor, synchronously moving the stand-connecting mechanical arm to a position right above the other pipe in the other mouse hole, and lowering the double stand until a connector at the lower portion of the double stand is placed into a connector at an upper portion of the other pipe, wherein a clamp head of the drill floor mechanical arm supports the lower portion of the double stand before the connector at the lower portion of the double stand leaves the drill floor;

step 6: extending the iron roughneck to the mouse hole including three pipes to make up the double stand and the other pipe to form a triple stand, retracting the iron roughneck after making up the double stand and the other pipe;

step 7: clamping, by the stand-connecting mechanical arm, the triple stand to move upward until a connector at a lower portion of the triple stand leaves the drill floor, wherein the clamp head of the drill floor mechanical arm supports the lower portion of the triple stand before the connector at the lower portion of the triple stand leaves the drill floor;

step 8: clamping or supporting an upper portion of the triple stand by the pipe racker on the finger board, opening the clamp head of the stand-connecting mechanical arm and driving the clamp head to move upward, clamping or supporting a lower portion of the triple stand by the drill floor mechanical arm;

step 9: vertically transporting, by the pipe racker on the finger board and the drill floor mechanical arm, the triple stand to the region of the at least one pipe setback, synchronously;

step 10: lowering, by the pipe racker on the finger board or the drill floor mechanical arm, the triple stand to the region of the at least one pipe setback, opening and retracting the clamp head of the pipe racker on the finger board and the clamp head of the drill floor mechanical arm, synchronously, returning the drill floor mechanical arm to a storage region.

15. The method of claim 14, wherein when a plurality of pipes need to be connected, the method further comprises:

repeating the steps of claim 14 to circularly connect a next triple stand offline.

16. The method of claim 14, wherein the drilling machine further includes a thread grease doper, wherein the method further comprises: during a process for connecting stands, the thread grease doper is integrated into the iron roughneck or the drill floor mechanical arm to dope a thread grease.

* * * * *